US010943475B2

(12) United States Patent
O'Callaghan

(10) Patent No.: US 10,943,475 B2
(45) **Date of Patent: *Mar. 9, 2021**

(54) PARKING SENSORS CAPABLE OF DETERMINING DIRECTION AND SPEED OF VEHICLE ENTERING OR LEAVING A PARKING LOT

(71) Applicant: The Parking Genius, Inc., Dallas, TX (US)

(72) Inventor: Sean O'Callaghan, Dallas, TX (US)

(73) Assignee: The Parking Genius, Inc., Dallas, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/601,277

(22) Filed: Oct. 14, 2019

(65) Prior Publication Data

US 2020/0043329 A1 Feb. 6, 2020

Related U.S. Application Data

(63) Continuation of application No. 15/711,897, filed on Sep. 21, 2017, now Pat. No. 10,446,024.

(51) Int. Cl.
*G08G 1/052* (2006.01)
*G08G 1/042* (2006.01)
(Continued)

(52) U.S. Cl.
CPC ..... *G08G 1/052* (2013.01); *G08G 1/0116* (2013.01); *G08G 1/0129* (2013.01); *G08G 1/042* (2013.01); *G08G 1/056* (2013.01); *G08G 1/065* (2013.01)

(58) Field of Classification Search
CPC .... G08G 1/052; G08G 1/0116; G08G 1/0129; G08G 1/042; G08G 1/056; G08G 1/065
See application file for complete search history.

(56) References Cited

U.S. PATENT DOCUMENTS 3,105,221 A * 9/1963 Schwarz ..... G06M 1/385 340/932.2
3,541,308 A * 11/1970 Ruby ..... G07F 17/145 235/378
(Continued)

FOREIGN PATENT DOCUMENTS

DE 10 2005 040 983 A1 8/2006
DE 10 2014 221 751 A1 4/2016
(Continued)

OTHER PUBLICATIONS

Ferreira et al., Self-automated parking lots for autonomous vehicles based on vehicular ad hoc networking. IEEE Intelligent Vehicles Symposium, 472-479, 2014. [retrieved on Jun. 11, 2017.] Retrieved from the Internet, 9 pages<URL:https://pdfs.semanticsscholar.org/f23e/25d41e9dfee3ce8a0e2be372c64aa1e2c91f.pdf>.
(Continued)

*Primary Examiner* — Rufus C Point
(74) *Attorney, Agent, or Firm* — Foley & Lardner LLP

(57) ABSTRACT

A parking inventory management system includes a sensor apparatus with a plurality of magnetometers each configured to respectively generate a magnetic signatures of a vehicle as it drives across the sensor apparatus. A computing device is associated with the sensor apparatus and compares the magnetic signatures of the vehicle generated by each of the plurality of magnetometers to the magnetic signatures of the vehicle generated by each other magnetometer of the plurality thereof so as to determine a direction of the vehicle. A match between the magnetic signature of the vehicle as generated by at least two of the plurality of magnetometers indicates that the direction of travel of the vehicle is along a direction between those two of the plurality of magnetometers. A speed of the vehicle is derived as a function of a time
(Continued)

difference between points of peak similarity between matching magnetic signatures of the vehicle.

17 Claims, 17 Drawing Sheets

(51) Int. Cl.
*G08G 1/056* (2006.01)
*G08G 1/01* (2006.01)
*G08G 1/065* (2006.01)

(56) References Cited

U.S. PATENT DOCUMENTS 4,239,415 A * 12/1980 Blikken ..... E01F 11/00 324/234
4,361,202 A * 11/1982 Minovitch ..... B60K 31/0008 104/88.02
5,331,276 A * 7/1994 Polvani ..... G01P 3/66 324/160
5,491,475 A * 2/1996 Rouse ..... G08G 1/042 324/244
5,621,314 A * 4/1997 Beck ..... G01P 3/66 324/179
5,648,904 A * 7/1997 Scott ..... G08G 1/0104 116/62.3
5,880,682 A * 3/1999 Soulliard ..... G08G 1/042 324/207.13
6,195,020 B1 * 2/2001 Brodeur, Sr. ..... B61L 29/22 246/125
6,675,123 B1 * 1/2004 Edelstein ..... G01V 3/081 702/150
6,865,455 B1 * 3/2005 Wiegert ..... G05D 1/0259 324/246
8,056,667 B2 11/2011 Moshchuk et al.
8,099,214 B2 1/2012 Moshchuk et al.
8,977,652 B2 3/2015 Hoefner et al.
9,311,816 B2 4/2016 Engler et al.
9,408,041 B1 8/2016 Abehassera et al.
9,696,721 B1 * 7/2017 Myers ..... G05D 1/0246
10,135,440 B2 11/2018 Taylor et al.
10,446,024 B2 * 10/2019 O'Callaghan ..... G08G 1/065
10,713,947 B2 * 7/2020 O'Callaghan ..... G08G 1/042
10,721,623 B2 * 7/2020 Albanese ..... H04W 12/06
10,803,423 B2 * 10/2020 Baker, Sr. ..... H04L 67/42
2001/0027360 A1 10/2001 Nakano et al.
2002/0190856 A1 12/2002 Howard
2004/0012481 A1 1/2004 Brusseaux
2004/0222903 A1 11/2004 Li
2005/0046598 A1 * 3/2005 Allen ..... G08G 1/015 340/933
2005/0280555 A1 12/2005 Warner
2007/0015485 A1 1/2007 Debiasio et al.
2007/0050240 A1 3/2007 Belani et al.
2007/0129974 A1 * 6/2007 Chen ..... G06Q 10/02 705/5
2007/0162218 A1 * 7/2007 Cattin ..... G08G 1/042 701/117
2007/0245158 A1 10/2007 Giobbi et al.
2008/0153515 A1 6/2008 Mock et al.
2010/0026521 A1 * 2/2010 Noel, II ..... G08G 1/042 340/932.2
2011/0048103 A1 3/2011 Su et al.
2011/0057815 A1 3/2011 King et al.
2011/0099126 A1 4/2011 Belani et al.
2011/0137773 A1 6/2011 Davis et al.
2011/0172909 A1 7/2011 Kahn et al.
2011/0213672 A1 9/2011 Redmann et al.
2012/0056758 A1 3/2012 Kuhlman et al.
2012/0092190 A1 4/2012 Stefik et al.
2012/0095791 A1 4/2012 Stefik et al.
2012/0109760 A1 * 5/2012 Koiso ..... G06Q 50/12 705/15
2012/0182160 A1 7/2012 Hod
2012/0246079 A1 9/2012 Wilson et al.
2012/0285790 A1 11/2012 Jones et al.
2013/0103200 A1 4/2013 Tucker et al.
2013/0135118 A1 5/2013 Ricci
2013/0147954 A1 6/2013 Song et al.
2014/0036076 A1 2/2014 Nerayoff et al.
2014/0046506 A1 2/2014 Reichel et al.
2014/0218218 A1 8/2014 Lloreda et al.
2014/0232518 A1 8/2014 Stoehr
2014/0232563 A1 * 8/2014 Engler ..... G08G 1/042 340/933
2014/0249742 A1 9/2014 Krivacic et al.
2014/0350853 A1 11/2014 Proux
2014/0368327 A1 12/2014 Darrer et al.
2015/0016661 A1 1/2015 Lord
2015/0066607 A1 3/2015 Fiorucci et al.
2015/0117704 A1 4/2015 Bulan et al.
2015/0138001 A1 5/2015 Davies et al.
2015/0149265 A1 5/2015 Huntzicker et al.
2015/0179070 A1 6/2015 Sandbrook
2015/0241241 A1 8/2015 Cudak et al.
2015/0279210 A1 10/2015 Zafiroglu et al.
2015/0294210 A1 10/2015 Martinez De Velasco Cortina et al.
2015/0317840 A1 11/2015 Dutta et al.
2015/0334678 A1 11/2015 MacGougan et al.
2015/0346727 A1 12/2015 Ramanujam
2015/0367234 A1 12/2015 Jones et al.
2015/0369618 A1 12/2015 Barnard et al.
2016/0071415 A1 3/2016 Maeda et al.
2016/0104328 A1 4/2016 Chen et al.
2016/0125736 A1 5/2016 Shaik
2016/0189435 A1 6/2016 Beaurepaire
2016/0203649 A1 7/2016 Berkobin et al.
2016/0219012 A1 7/2016 Liao et al.
2016/0275794 A1 9/2016 Chang
2016/0286627 A1 9/2016 Chen et al.
2016/0328961 A1 * 11/2016 Garces Cadenas ..... G01V 3/08
2017/0008515 A1 1/2017 Seo et al.
2017/0109942 A1 * 4/2017 Zivkovic ..... H04W 4/023
2017/0132922 A1 5/2017 Gupta et al.
2017/0140645 A1 5/2017 Balid et al.
2017/1460645 5/2017 Balid et al.
2017/0200365 A1 * 7/2017 Baker, Sr. ..... G08G 1/144
2018/0061145 A1 * 3/2018 Blustein ..... G08G 1/14
2018/0089631 A1 * 3/2018 Baker, Sr. ..... G06Q 10/1093
2018/0114438 A1 4/2018 Rajagopalan et al.
2018/0122152 A1 5/2018 Shin
2018/0247534 A1 * 8/2018 Williams ..... G08G 1/142
2019/0088119 A1 * 3/2019 O'Callaghan ..... G08G 1/052
2019/0088129 A1 * 3/2019 O'Callaghan ..... G08G 1/127

FOREIGN PATENT DOCUMENTS

DE 10 2014 221 777 A1 4/2016
DE 10 2015 202 471 A1 8/2016
WO WO-2015/144396 10/2015
WO WO-2016/130719 A2 8/2016

OTHER PUBLICATIONS

Final Office Action on U.S. Appl. No. 14/995,148 dated Mar. 12, 2019.
Final Office Action on U.S. Appl. No. 14/995,157 dated Oct. 30, 2018.
Final Office Action on U.S. Appl. No. 14/995,157 dated Nov. 25, 2019.
Final Office Action on U.S. Appl. No. 15/280,790 dated Apr. 2, 2019.
Final Office Action on U.S. Appl. No. 15/711,796 dated Oct. 22, 2018.
International Preliminary Report on Patentability for PCT/US2017/053672 dated Apr. 11, 2019, 13 pages.
International Preliminary Report on Patentability for PCT/US2017/062180 dated Jun. 6, 2019, 7 pages.

(56) References Cited

OTHER PUBLICATIONS

International Preliminary Report on Patentability re PCT/US2017/012292 dated Jul. 26, 2018, 15 pages.
International Search Report and Written Opinion for corresponding International Patent Application No. PCT/US2017/053672 dated Dec. 1, 2017, 15 pages.
International Search Report and Written Opinion for corresponding International Patent Application No. PCT/US2017012292 dated Jul. 7, 2017, 22 pages.
International Search Report and Written Opinion for PCT/US2018/52005 dated Jan. 29, 2019, 7 pages.
International Search Report and Written Opinion dated Oct. 29, 2018 in PCT/US2018/051568; 14 pages.
International Search Report and Written Opinion dated Feb. 13, 2018 for International Patent Application No. PCT/US2017/062180, 8 pages.
Non-Final Office Action on U.S. Appl. No. 15/360,670, dated Sep. 20, 2018, 11 pgs.
Non-Final Office Action on U.S. Appl. No. 14/995,148 dated Aug. 23, 2018.
Non-Final Office Action on U.S. Appl. No. 14/995,148 dated Oct. 4, 2019.
Non-Final Office Action on U.S. Appl. No. 14/995,157 dated Mar. 7, 2019.
Non-Final Office Action on U.S. Appl. No. 15/280,790 dated Oct. 29, 2018.
Non-Final Office Action on U.S. Appl. No. 15/711,796 dated May 17, 2018.
Non-Final Office Action on U.S. Appl. No. 15/711,897 dated Jan. 18, 2019.
Non-Final Office Action on U.S. Appl. No. 16/416,662 dated Nov. 7, 2019.
Non-Final Office Action on U.S. Appl. No. 16/442,031 dated Jul. 17, 2019.
Non-Final Office Action on U.S. Appl. No. 14/995,157, dated May 9, 2018, 26 pgs.
Notice of Allowance on U.S. Appl. No. 15/360,670 dated Jan. 8, 2019.
Notice of Allowance on U.S. Appl. No. 15/711,796 dated Feb. 4, 2019.
Notice of Allowance on U.S. Appl. No. 15/711,796 dated Dec. 28, 2018.
Notice of Allowance on U.S. Appl. No. 15/711,796 dated Apr. 12, 2019.
Notice of Allowance on U.S. Appl. No. 15/711,796 dated Apr. 22, 2019.
Notice of Allowance on U.S. Appl. No. 15/711,897 dated Aug. 14, 2019.
Notice of Allowance on U.S. Appl. No. 15/711,897 dated Sep. 20, 2019.
U.S. Appl. No. 14/995,148, filed Jan. 13, 2016, System for Monitoring Arrival of a Vehicle at a Given Location and Associated Methods.
U.S. Appl. No. 14/995,157, filed Jan. 13, 2016, System for Monitoring Arrival of a Vehicle at a Given Location and Associated Methods.
U.S. Appl. No. 15/280,790, filed Sep. 29, 2016, System for Managing Parking of Autonomous Driving Vehicles.
U.S. Appl. No. 16/416,662, filed May 20, 2019, User Validation System Utilizing Symbolic or Pictographic Representations of Validation Codes.
U.S. Appl. No. 16/442,031, filed Jun. 14, 2019, Parking Sensors Capable of Determining Direction and Speed of Vehicle Entering or Leaving Parking Lot Using Magnetic Signature Recognition.
Final Office Action on U.S. Appl. No. 16/416,662 dated Mar. 13, 2020.
Non-Final Office Action on U.S. Appl. No. 15/280,790 dated Mar. 24, 2020.
European Search Report for EP Patent Application No. 17857317.6 dated Feb. 4, 2020.
Final Office Action on U.S. Appl. No. 14/995,148 dated Feb. 14, 2020.
Final Office Action on U.S. Appl. No. 16/442,031 dated Dec. 26, 2019.
Non-Final Office Action on U.S. Appl. No. 14/995,157 dated Jul. 14, 2020.

* cited by examiner

PARKING SENSORS CAPABLE OF DETERMINING DIRECTION AND SPEED OF VEHICLE ENTERING OR LEAVING A PARKING LOT

CROSS-REFERENCE TO RELATED APPLICATIONS

Pursuant to 35 U.S.C. § 119(e), this application is a continuation of and claims the benefit of, U.S. patent application Ser. No. 15/711,897 entitled "PARKING SENSORS CAPABLE OF DETERMINING DIRECTION AND SPEED OF VEHICLE ENTERING OR LEAVING A PARKING LOT," filed on Sep. 21, 2017, and naming Sean O'Callaghan as inventor, the contents of which are hereby incorporated herein by reference in their entirety for any purpose.

TECHNICAL FIELD

This disclosure is related to the field of parking lot monitoring, and, more particularly, to systems and methods for monitoring vehicle arrival, and for determining the direction and speed of arriving vehicles.

BACKGROUND

In many cities, motor vehicles such as cars are the predominant mode of transportation utilized by residents. In some cases, parking lots for motor vehicles are not monitored or attended, and motor vehicles come and go at the direction of their drivers. However, in other cases, parking lots are to be monitored using automated parking lot management systems.

For example, a device may be installed at the entrance of a parking lot that monitors the number of vehicles in the lot via a counter. However, such vehicle sensors have a variety of inherent drawbacks in their designs. For example, such vehicle sensors may be incapable of determining in what direction a vehicle is traveling, which can lead to an inaccurate count of vehicles in the parking lot in the case where a driver fails to utilize certain designated entrances and exits, or where a driver drives erratically back and forth through an entrance or exit (possibly to use a payment device placed at said entrance or exit).

Therefore, a vehicle sensor capable of detecting not only presence of a vehicle, but also the direction of the vehicle is desirable, as that would permit design of a parking monitoring system that addresses the above drawbacks. In addition, a vehicle sensor capable of also detecting speed of the vehicle would be desirable, as it would permit better monitoring of traffic flow within the parking lot. Therefore, it is evident that there has been a need for further developments in the area of parking systems and parking sensors.

SUMMARY

The above described need has now been met by the systems, technologies, techniques, and methods described hereinbelow. It should first be noted that this summary is provided to introduce a selection of concepts that are further described below in the detailed description. This summary is not intended to identify key or essential features of the claimed subject matter, nor is it intended to be used as an aid in limiting the scope of the claimed subject matter.

Disclosed herein is a system including a sensor apparatus comprising a plurality of magnetometers each configured to respectively generate magnetic signatures of a vehicle as it drives across the sensor apparatus, and a computing device associated with the sensor apparatus. The computing device is configured to compare the magnetic signatures of the vehicle generated by each of the plurality of magnetometers to the magnetic signatures of the vehicle generated by each other magnetometer of the plurality thereof so as to determine a direction of travel of the vehicle. A match between magnetic signature of the vehicle as generated by at least two of the plurality of magnetometers indicates that the direction of travel of the vehicle is along a direction between those two of the plurality of magnetometers.

A method aspect is directed to a method of parking lot inventory management. The method includes disposing at least one sensor apparatus, each comprising a plurality of magnetometers, at each entry or exit lane to the parking lot. For each sensor apparatus, the method includes comparing magnetic signatures of a vehicle driving over that sensor apparatus generated by each of the plurality of magnetometers of that sensor apparatus to the magnetic signatures of the vehicle generated by each other magnetometer of the plurality of magnetometers of that sensor apparatus so as to determine a direction of travel of the vehicle. A match between magnetic signatures of the vehicle as generated by at least two of the plurality of magnetometers of that sensor apparatus indicates that the direction of travel of the vehicle is along a direction between those two of the plurality of magnetometers of that sensor apparatus. A count of vehicles in the parking lot is incremented as a function of the direction of travel of the vehicle indicating that the vehicle is entering the parking lot. A count of vehicles in the parking lot is decremented as a function of the direction of travel of the vehicle indicating that the vehicle is leaving the parking lot.

Also disclosed herein is a system including a sensor apparatus with a plurality of sensors each configured to respectively generate signatures of a vehicle as it drives across the sensor apparatus. A computing device is associated with the sensor apparatus and configured to compare the signatures of the vehicle generated by each of the plurality of sensors to the signatures of the vehicle generated by each other sensor of the plurality thereof so as to determine a direction of travel of the vehicle. A match between signatures of the vehicle as generated by at least two of the plurality of sensors indicates that the direction of travel of the vehicle is along a direction between those two of the plurality of sensors.

BRIEF DESCRIPTION OF THE DRAWINGS

So that the above recited features can be understood in detail, a more particular description may be had by reference to embodiments, some of which are illustrated in the appended drawings, wherein like reference numerals denote like elements. It is to be noted, however, that the appended drawings illustrate various embodiments and are therefore not to be considered limiting of its scope, and may admit to other equally effective embodiments.

DETAILED DESCRIPTION

In the following description, numerous details are set forth to provide an understanding of the present disclosure. It will be understood by those skilled in the art, however, that the embodiments of the present disclosure may be practiced without these details and that numerous variations or modifications from the described embodiments may be possible.

Figure 1A:
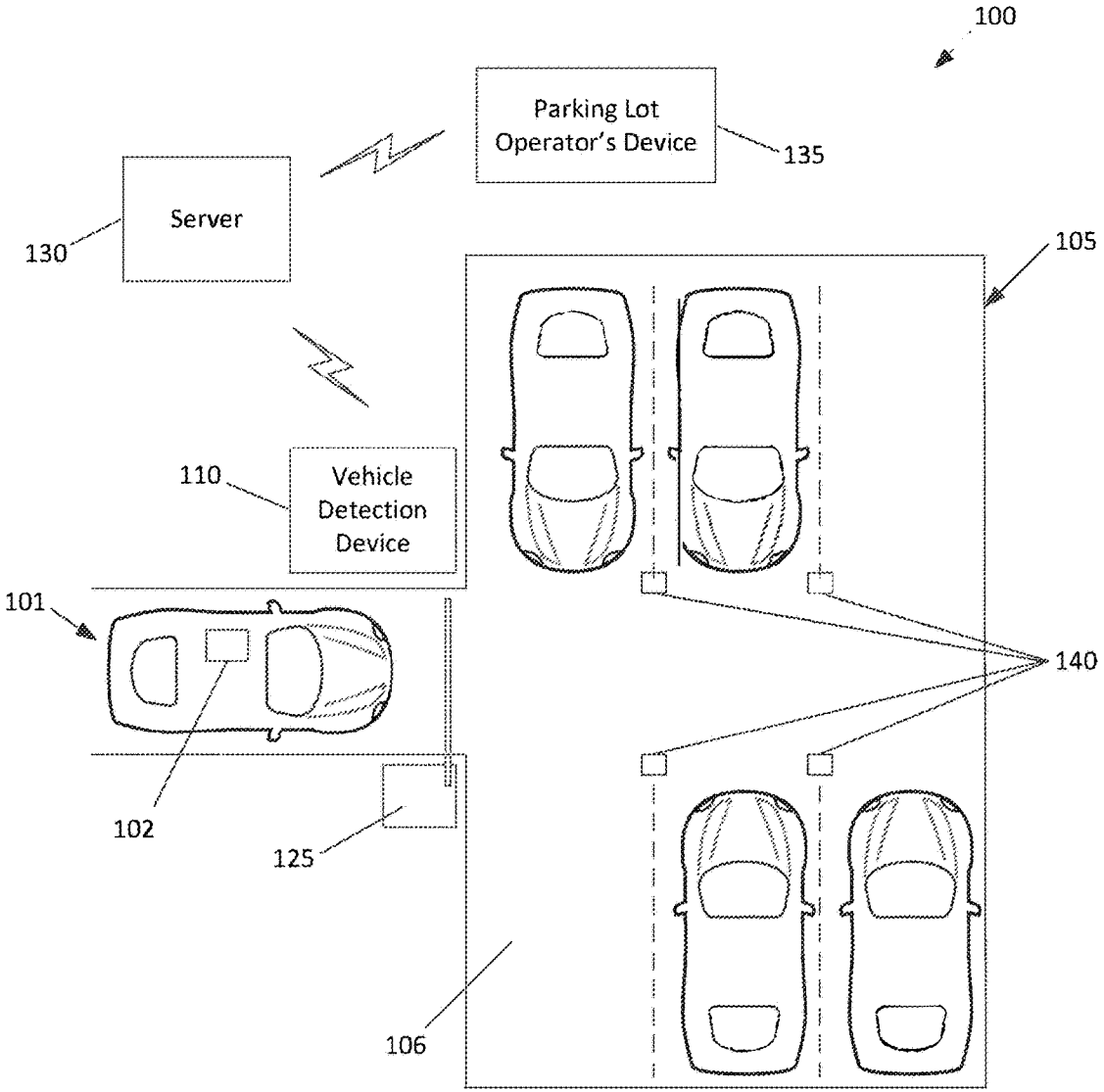
FIG. 1A is a block diagram of a system for monitoring arrival of vehicles, as installed at a parking lot, in accordance with the present disclosure.

With reference to FIG. 1A, a system 100 for monitoring arrival of vehicles is now described. The system 100 is installed at a parking lot 105, at which motor vehicles, such as cars, trucks, and motorcycles may be parked. A vehicle detection device 100 detects arrival of vehicles and/or entry of vehicles and/or departure of vehicles to or from the parking lot 105. As show, a vehicle 101 is adjacent a motor operated gate 125 selectively that permits vehicles to enter and depart from the parking lot 105. A server 130 is in communication with the vehicle detection device 110 over a network, such as the Internet, and receives data from the vehicle detection device 110. The server 130 processes this data 130, and may then send output to, or prompt for input from, a device of an operator of the parking lot 135, or a device 102 within the vehicle 101. Optional sensors or indicators 140 are installed adjacent parking spots 106.

The device 102 within the vehicle 101 may be a mobile wireless communications device utilized by the driver or passenger of the vehicle 101, such as a smartphone, smartwatch, or tablet, or may be a device integrated within the vehicle 101, such as an infotainment system.

Figure 4A:
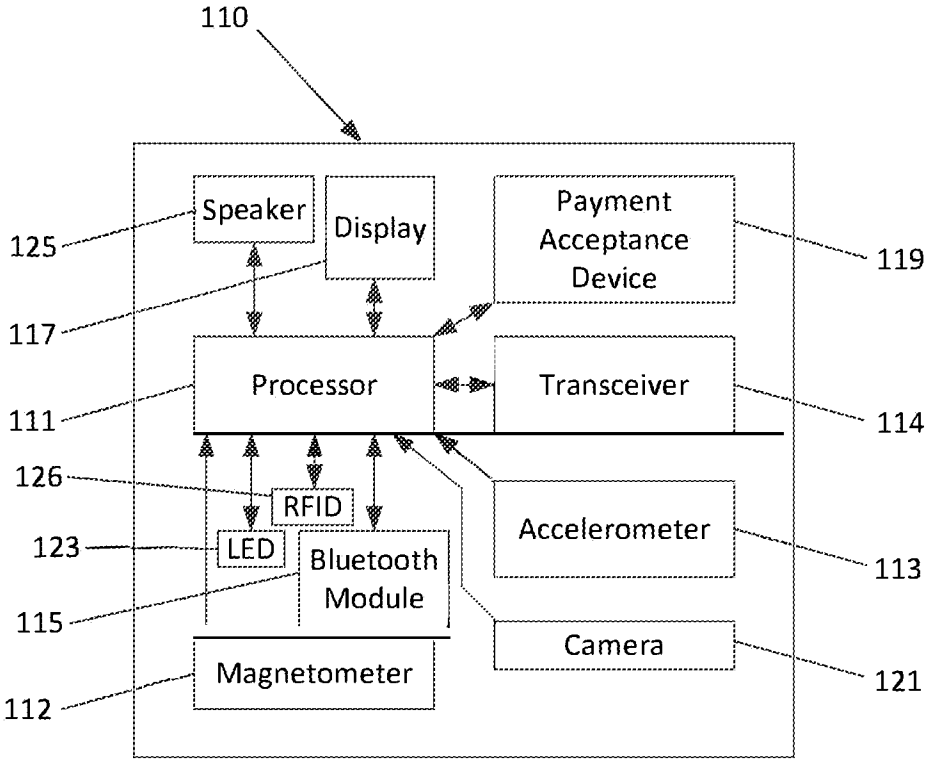
FIG. 4A is a block diagram of a vehicle detection device such as may be used with the systems shown in FIGS. 1-3.

With additional reference to FIG. 4A, further details of the vehicle detection device 110 will now be given. The vehicle detection device 110 includes a processor 111, such as a microprocessor or system on a chip. Coupled to the processor 111 is a magnetometer 112, as well as an accelerometer 113. A Bluetooth module 115 is coupled to the processor 111 for potential communication with the device 102 within the vehicle 101, and a transceiver 114 is coupled to the processor 111 for communication with the server 130 over the wide area network, and/or also with other vehicle detection devices 110 if present, and/or also with the optional sensors 140. A display 117, LED 123, and speaker 125 are coupled to the processor 111 for providing visual or audio output to a user. The display 117, LED 123, and speaker 125 may be utilized for any provided output described below instead of the device 102. A camera 121 is coupled to the processor 111 for taking pictures, such as of the license plate of the vehicle 101, which may be sent to and processed by the server. A payment acceptance device 119 is coupled to the processor 111 for accepting payment from a user. The payment acceptance device 119 may utilize magnetic strip, chip and pin, NFC, or other electronic payment acceptance technologies. In addition, the payment acceptance device 119 may also directly accept hard currency, such as bills and coins. A RFID reader 126 is coupled to the processor 111 for reading RFID tags associated with the vehicle, such as a toll tag mounted in the vehicle, or RFID tags within the tires of the vehicle.

A payment acceptance device 119 is coupled to the processor 111 for accepting payment from a user. The payment acceptance device 119 may utilize magnetic strip, chip and pin, NFC, or other electronic payment acceptance technologies. In addition, the payment acceptance device 119 may also directly accept hard currency, such as bills and coins. It should be appreciated that in some applications, the payment acceptance device 119 may be part of, or may be, the RFID reader 126.

The magnetometer 112 serves to sense metal in vehicles 101 via a change in the local magnetic field, and can thus detect the presence of vehicles 101. The processor 111 may be able to interpret reading from the magnetometer 112 to estimate the dimensions of the vehicle 101, from which a type or configuration of the vehicle may be inferred (i.e. a vehicle estimated to be a car, whereas a larger vehicle is likely to be a truck).

The accelerometer 113 serves to detect vibrations in multiple axes, such as those caused by a passing vehicle 101, and can therefore be used to determine whether the vehicle 101 is entering or leaving the given area. By logging the magnitude and direction of vibrations detected by the accelerometer 113, the processor 111 can infer both the speed of the vehicle, as well as whether the vehicle is arriving or departing.

Due to the use of the accelerometer 113 and magnetometer 112 for detecting vehicles 101, the vehicle detection device 110 is positioned at the entrance and exit to the parking lot 105, and needs not be driven over by the vehicle 101 in order for detection to occur.

As stated, the RFID reader 126 may read RFID tags associated with the vehicle. Thus, the RFID reader 126 may read a code from the RFID tag, and the code may be a toll tag ID number, or may be a tire identification code. Where the code is a toll tag ID, the information about the vehicle may be the toll tag ID, which may in turn be used for identification of the user by looking up the user's information in a table of toll tag ID's, or in processing payment via the toll tag ID. Where the code is a tire identification code, the information about the vehicle may be the tire identification code, which may in turn be used by the server to determine a make and model of the tires on the vehicle, which may in turn be used to determine the type of vehicle and vehicle configuration, as well as the make and model of the vehicle. Also, the information about the vehicle may include the various measurements taken by the accelerometer 113 and magnetometer 112 as well as the make and model of the tires, which may be used to more accurately determine the type of vehicle and vehicle configuration, as well as the make and model of the vehicle.

As stated above, using the transceiver 114, the vehicle detection device 110 may communicate with other vehicle detection devices 110. In addition, one vehicle detection device 110 may act as a relay for another vehicle detection device 110, transmitting information received therefrom to the server 130, or to the device 102 within the vehicle 101. The transceiver 114 may also be used by the vehicle detection device 110 for communication with a fixed or mobile device used by a parking lot attendant, such as a smartphone, tablet, or pay station. The processor 111 may also cooperate with additional vehicle detection hardware, such as a pressure sensor for vehicle sensing, allowing retrofitting of the vehicle detection device 110 to existing parking lot management installations. In addition, the processor 111 may also cooperate with hardware, such as RFID readers, that read toll tags or toll passes, and/or Bluetooth connections from which vehicle information may be read, and via which payment for parking may be effectuated.

Figure 1B:
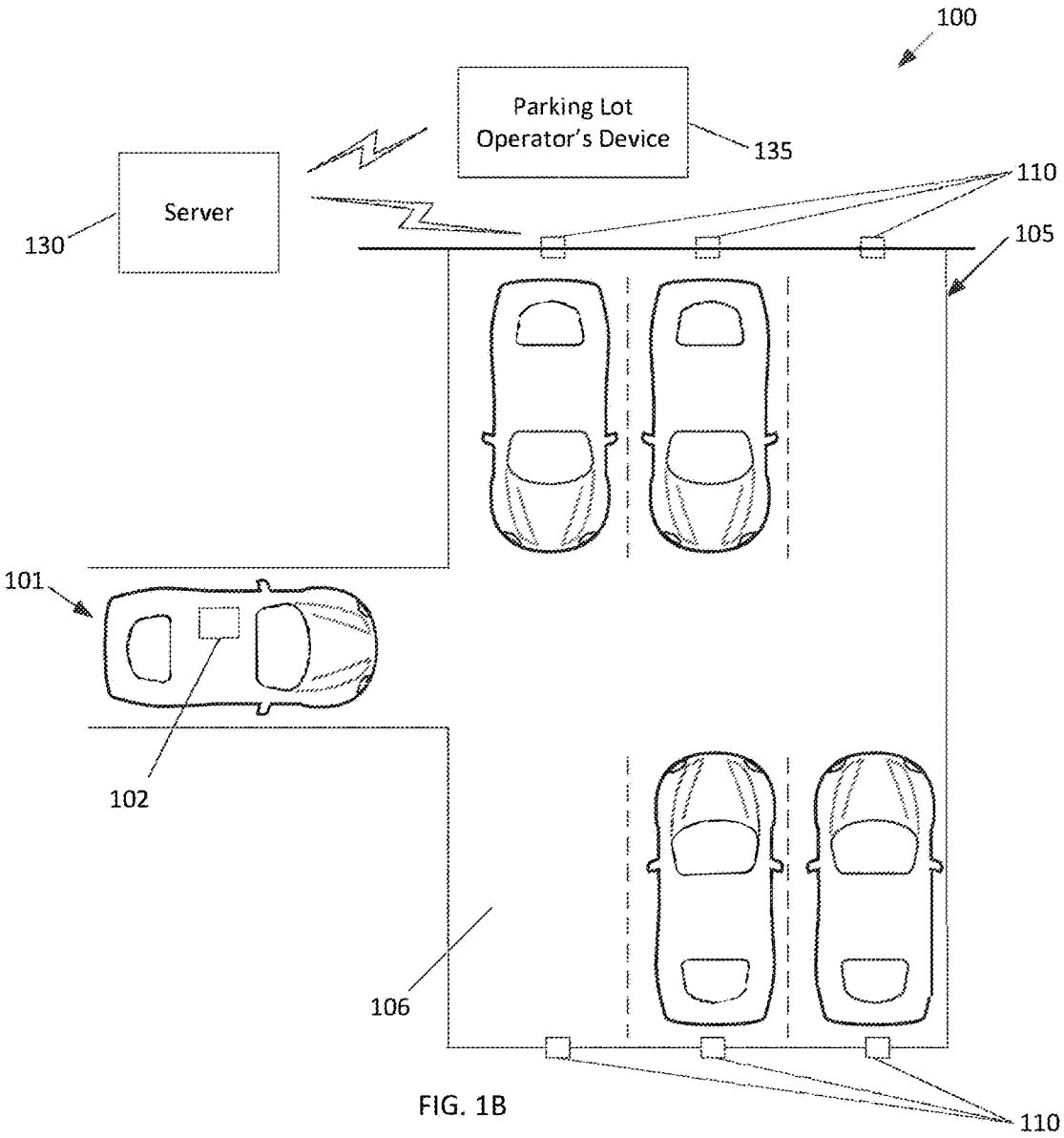
FIG. 1B is a block diagram of a different embodiment of a system for monitoring arrival of vehicles, as installed at a parking lot, in accordance with the present disclosure.

In some applications, such as that shown in FIG. 1B, rather than the vehicle detection device 110 being at the entrance to the parking lot 105, there is a separate vehicle detection device 110 located in each parking space 106. Each of these vehicle detection devices 110 may have the components as described above and below, and may operate as described above and below. In addition, it should be understood that the various vehicle detection devices 110 may communicate with one another via their transceivers 114, their Bluetooth modules 115, or a combination thereof. This communication may be to relay data to and from the server 130, for example. In addition, the various vehicle detection devices 110 may cooperate using their Bluetooth modules 115 to perform triangulation to determine the position of the vehicle 101 within the parking lot 105, and may then direct the driver of the vehicle 101 to the parking space 106 via the device 102 within the vehicle 101, or via their respective displays 117, LEDs 123, and/or speakers 125.

Figure 1C:
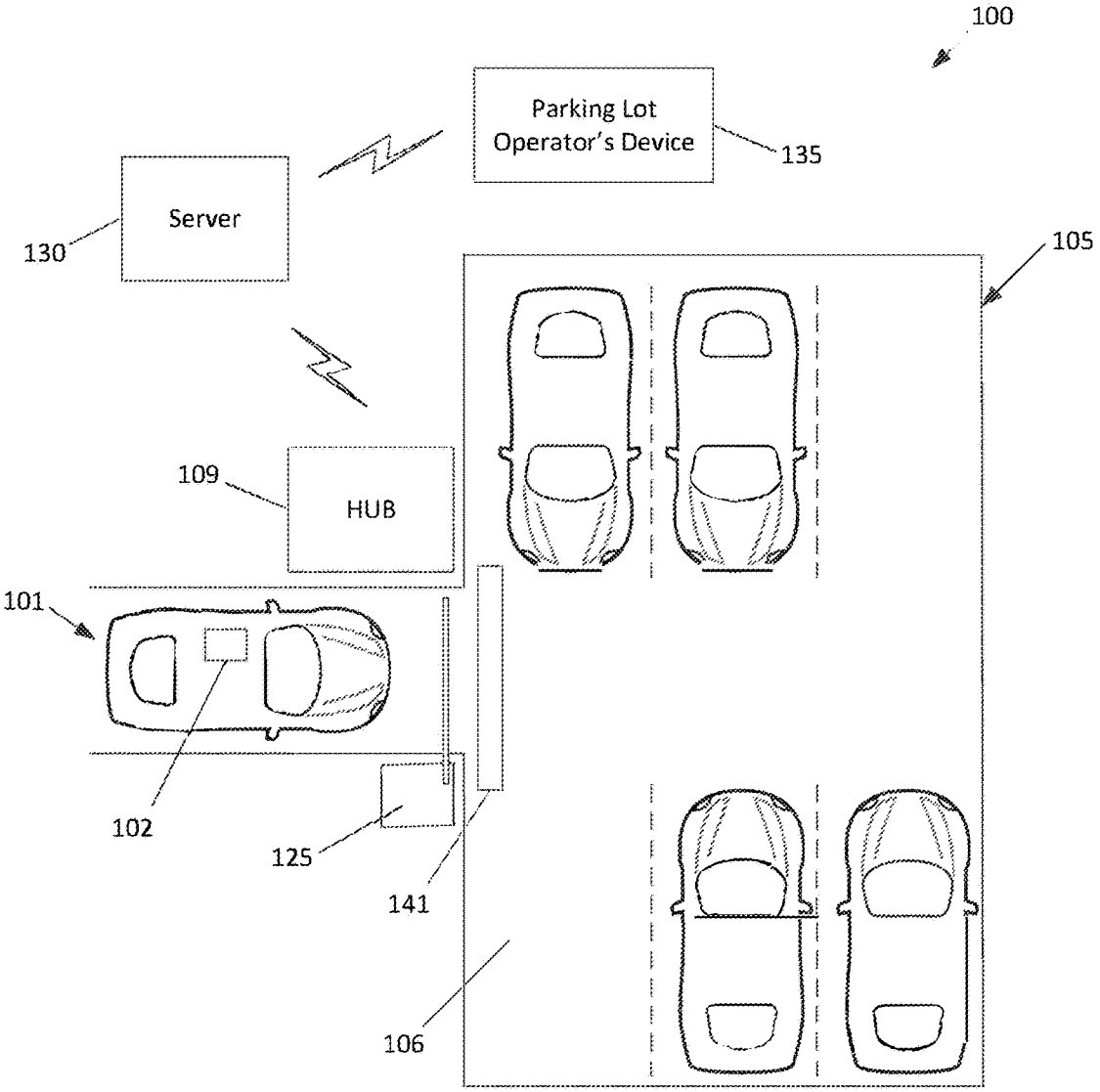
FIG. 1C is a block diagram of a further embodiment of a system for monitoring arrival of vehicles, as installed at a parking lot, in accordance with the present disclosure.
Figure 1D:
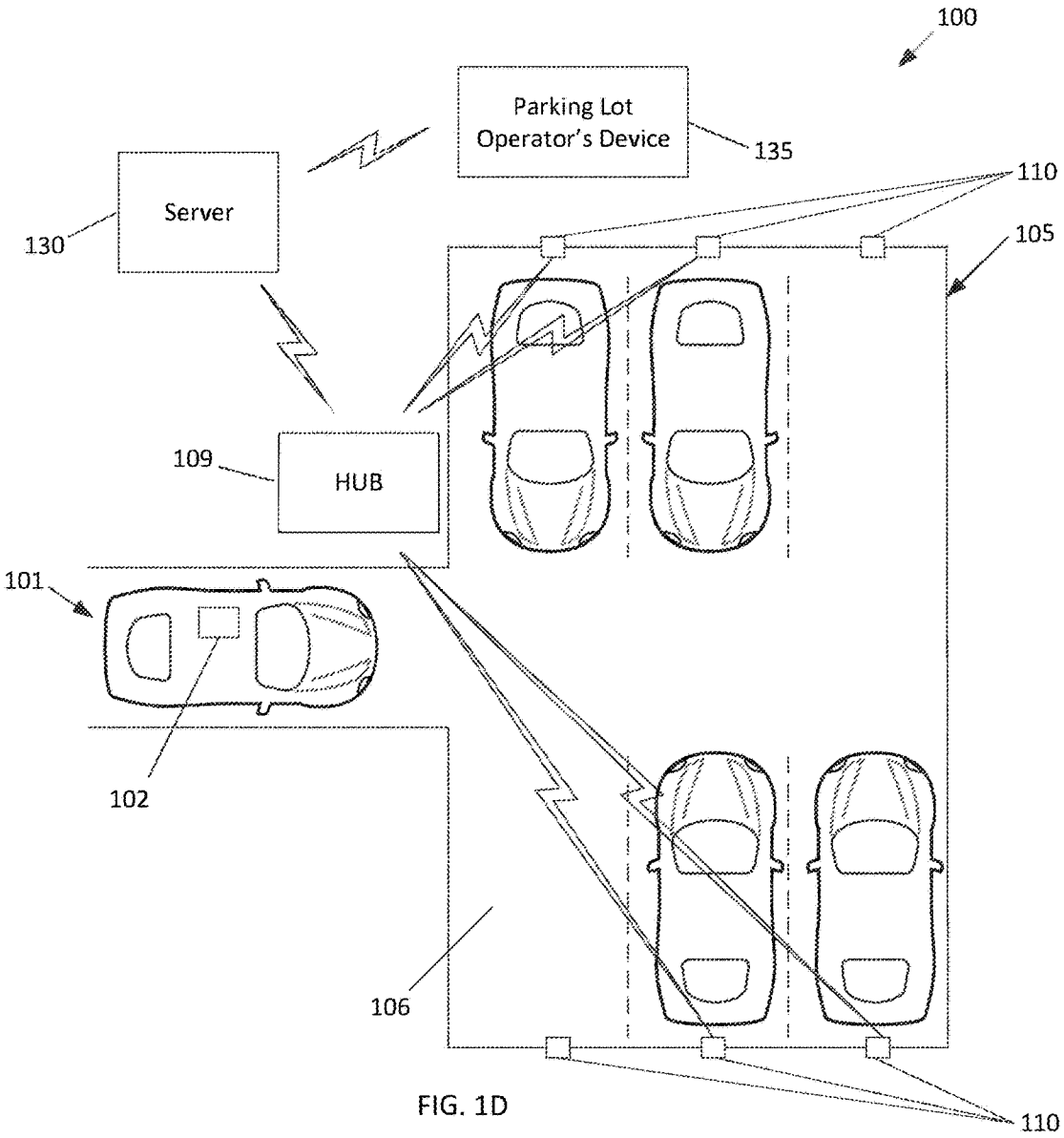
FIG. 1D is a block diagram of an additional embodiment of a system for monitoring arrival of vehicles, as installed at a parking lot, in accordance with the present disclosure.

In other applications, such as that shown in FIG. 1D, rather than directly communicating with the server 130, each vehicle detection device 110 communicates with a hub 109 either wirelessly or over a wire, and the hub 109 in turn communicates with the server 130, serving to pass data to the server 130 from the vehicle detection devices 110, and serving to pass data to the vehicle detection devices 110 from the server 130. It should also be appreciated that the hub 109 may perform any of the functions described above or below as being performed by the vehicle detection device 110.

Figure 5:
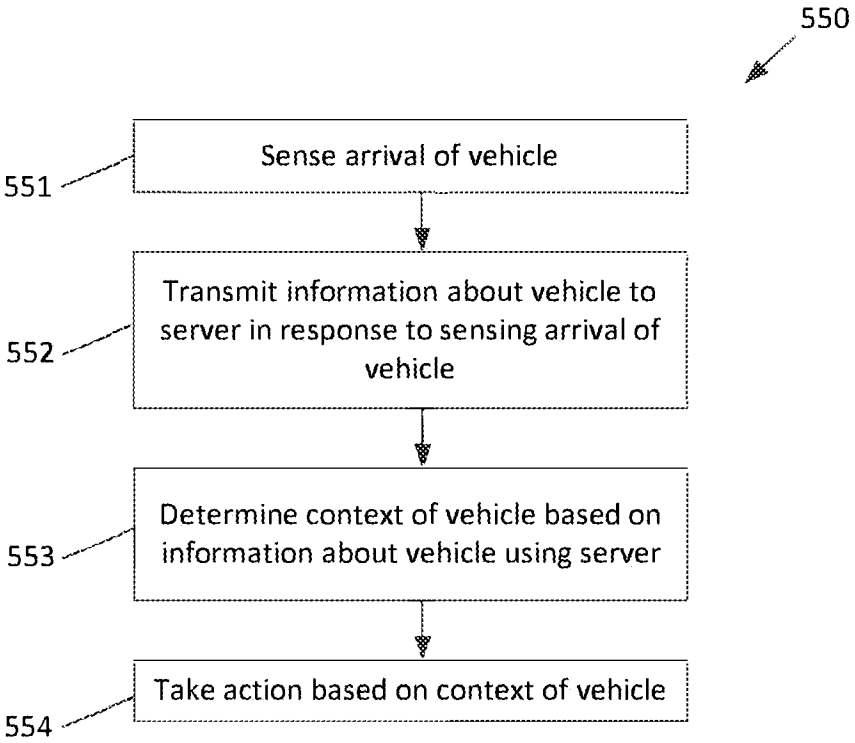
FIG. 5 is a flowchart of a method of monitoring arrival of vehicles, in accordance with the present disclosure.

With additional reference to the flowchart 550 of FIG. 5, a method of monitoring vehicle 101 arrival to a given location, such as a parking lot 105, is now described. The vehicle detection device 110, as described above, operates to sense arrival (or departure) of a vehicle 101 (Block 551). The vehicle detection device 110 then sense information about the vehicle 101, and sends it to the server 130 in response to the sensing of arrival or departure (Block 552). The information about the vehicle may be sensed via the magnetometer 112 and accelerometer 113, and/or may be sensed via interaction with the device 102 within the vehicle 101 via the Bluetooth module 115, or via the transceiver 114.

Next, the server 130 determines a context of the vehicle 101 based on the information received from the vehicle detection device 110 (Block 553). Thereafter, the server 130 takes at least one action based on the context of the vehicle 101 (Block 554).

Through sensing different types of information about the vehicle 101, through determining different contexts, and through taking different actions, the system 100 may be used in a wide variety of applications. For example, the application shown in FIG. 1A is that where the system 100 is installed at a parking lot 105.

A first parking related application is where a driver of the vehicle 101 has prepaid for parking via the device 102. When the vehicle 101 arrives to the parking lot 105, the vehicle detection device 110 operates to read the prepayment (or voucher) information from the device 102, or serves to identify the vehicle 101 via the device 102 and then query the server 130 for the prepayment or voucher information. If the prepayment or voucher is valid (i.e. has been properly paid for the correct amount, and/or if it is an authorized time of day, date, or day of the week), the vehicle detection device 110 or server 130 instructs the gate 125 to open, and updated parking lot inventory information is sent to the parking lot operator's device 135.

If no prepayment is present, or if the prepayment or voucher is not valid for the present time, the vehicle detection device 110 may, either on its own via its display 117, LED 123, and speaker 125, or via the device 102 in the vehicle 101, demand payment for the right to park the vehicle 101 in the parking lot 105. If, within a given amount of time, the payment is not received (from either the device 102, or in pieces from multiple devices 102, or via the payment acceptance device 119) and the vehicle 101 has not left the parking lot, the vehicle detection device 110, either on its own or via the server 130, may notify the parking lot operator's device 135 that the vehicle 101 is parked in the parking lot 105 without having paid for the right to do so.

In a second parking related application, the vehicle detection device 110 serves to detect the number of devices 102 in the vehicle 101, and transmits that information to the server. Since the majority of adults carry a smartphone in today's world, from this number of devices 102 in the vehicle 101, the server 130 can estimate the number of people in the vehicle 101, and may transmit this data to the parking lot operator's device 135, may save this data for future analytics, or may transmit this data to other devices, such as those within a venue adjacent the parking lot 105.

In a third parking related application, the vehicle detection device 110 serves to read user identity information from the device 102 in the vehicle, or to request user identity information associated with the device 102 from the server 130. Then, the server 130 can notify the parking lot operator or venue that the user matching the user identity information has arrived. Therefore, the parking lot operator or venue can prepare for the arrival of that specific user.

As an example, the specific user may have reserved a given parking space 106, and the parking lot operator may manually (via a human attendant) direct the vehicle 101 to park in the parking space 106, or the server 130 may direct the vehicle 101 to park in the parking space 106 via displays incorporated with the sensors 140, or via the display 117, LED 123, and/or speaker 125. In addition, in some applications, the sensors 140 may report to the parking lot operator, the vehicle detection device 110, or the server 130 which spaces are occupied. This functionality may also be performed by the vehicle detection device 110. If the vehicle detection device 110, via the sensors 140 or on its own, determines that the reserved space 106 has been improperly occupied (i.e. the space 106 is occupied, but the vehicle detection device 110 has not detected the device 102 of the specific user), the vehicle detection device 110 may directly or via the server 130 notify the parking lot operator's device 135 that the parking space 106 is occupied by an unauthorized vehicle.

In any such parking applications wherein payment is collected for the parking space 106, the vehicle detection device 110 may determine both an arrival time and a departure time of the vehicle 101, and the payment amount may be based upon the length of time between the arrival time and departure time. The payment amount may be additional or alternatively be based upon the time of day, date, or day of week of the arrival time and/or departure time—for example the payment may be greater on a Saturday than on a Tuesday, or may be less at 2:00 AM than at 9:00 AM. In addition, the payment amount may be dependent upon the weight, type, or configuration of the vehicle 101 (e.g. vehicle size, vehicle weight, vehicle body style, etc), as determined based on readings from the magnetometer 112 and/or accelerometer 113.

In some cases, the vehicle 101 may be authorized to park in the parking lot 105 at the time of parking, but may at a later point in time, before departure, become no longer authorized. For example, the parking lot 105 may be operated by a municipality, and may need to be emptied for street cleaning, trash pickup, etc. In such cases, the server 130 may notify the parking lot operator's device 135 (and thus the municipality's device) that certain vehicles have not yet departed. The municipality can then take appropriate action. In some cases, such notification may additional or alternatively be sent to the device 102.

Another parking application may be where the parking lot 105 is a valet parking lot. The vehicle detection device 110 may this record a unique identifier for the vehicle when it entered the parking lot 105, and thus unique identifier may be transmitted, via the server 130 or directly, to the device 102. A user may request retrieval of the vehicle 101 via provided input to the device 102.

Figure 2:
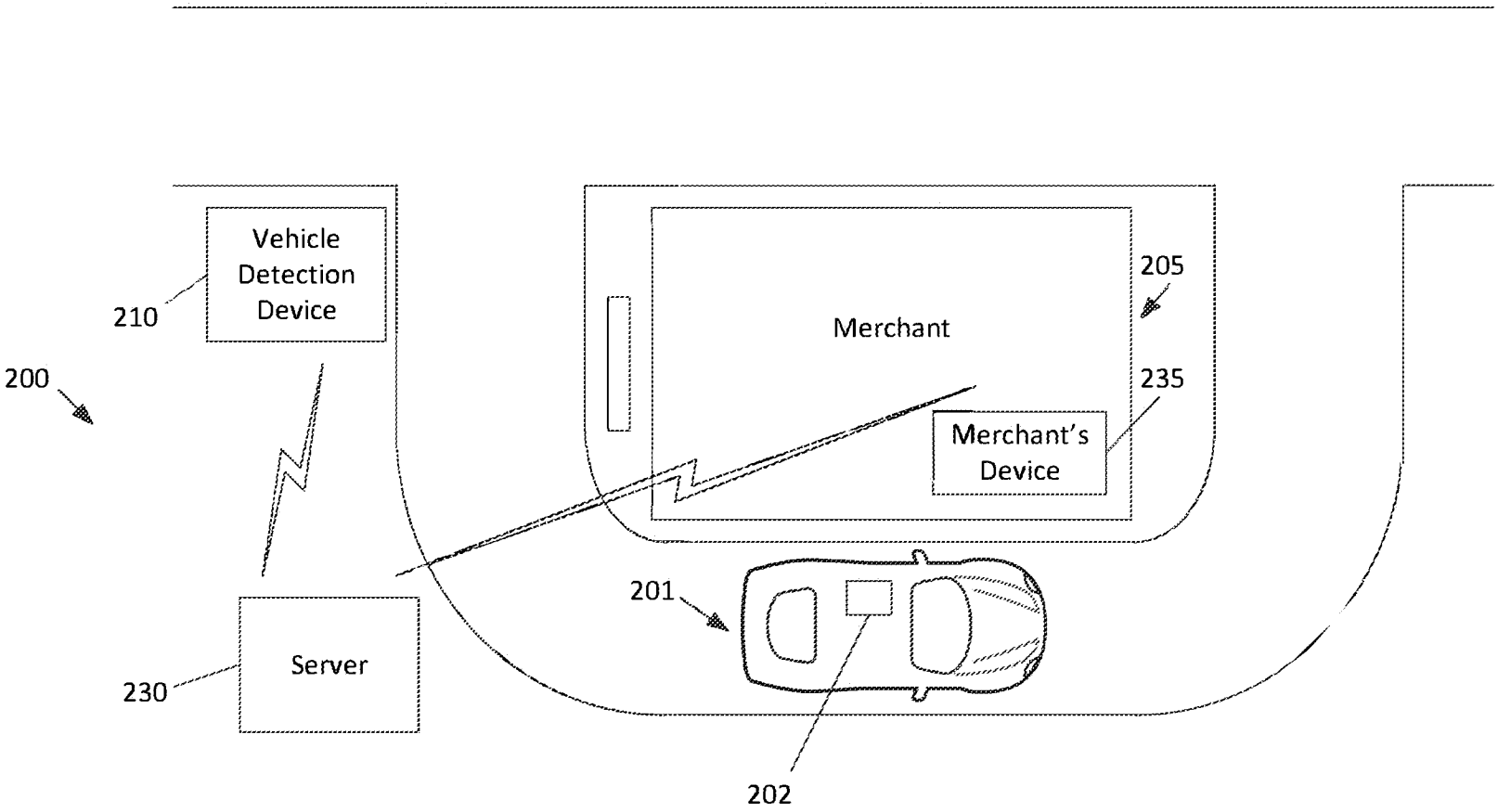
FIG. 2 is a block diagram of a system for monitoring arrival of vehicles, as installed at a merchant, in accordance with the present disclosure.

Another application for the system 200 in which the system 200 is employed at a merchant is now described with additional reference to FIG. 2. Here, the parking lot 205 is a parking lot for a merchant, such as a restaurant, and 205 may be a drive through lane instead of a parking lot. The vehicle detection device 210 can detect when the vehicle 201 arrives at the merchant, and can read the identify of a user from the device 202, or request an identity of the user from the server 230 based on information received from the device 202. The server 230 may then send the identity of the user to the merchant's device 235, which may retrieve order information for the user. In some applications, the server 230 may have the order information for the user, and may pass the order information along to the merchant's device 235. In yet another application, the vehicle detection device 210 may cause the device 202 to prompt the user to enter an order. The user's order may then be transmitted to a device inside the Merchant's business wherein it is prepared and delivered to the user. In the case of 205 being a drive through lane, the system 200 may compute the time required to prepare the user's order and, comparing such time to the time required to prepare other users' orders within the drive through lane, may direct the Merchant's employees to prepare orders in a sequence different from the sequence of vehicles in the drive through queue in an effort to minimize user wait times and maximize efficiency.

Figure 3:
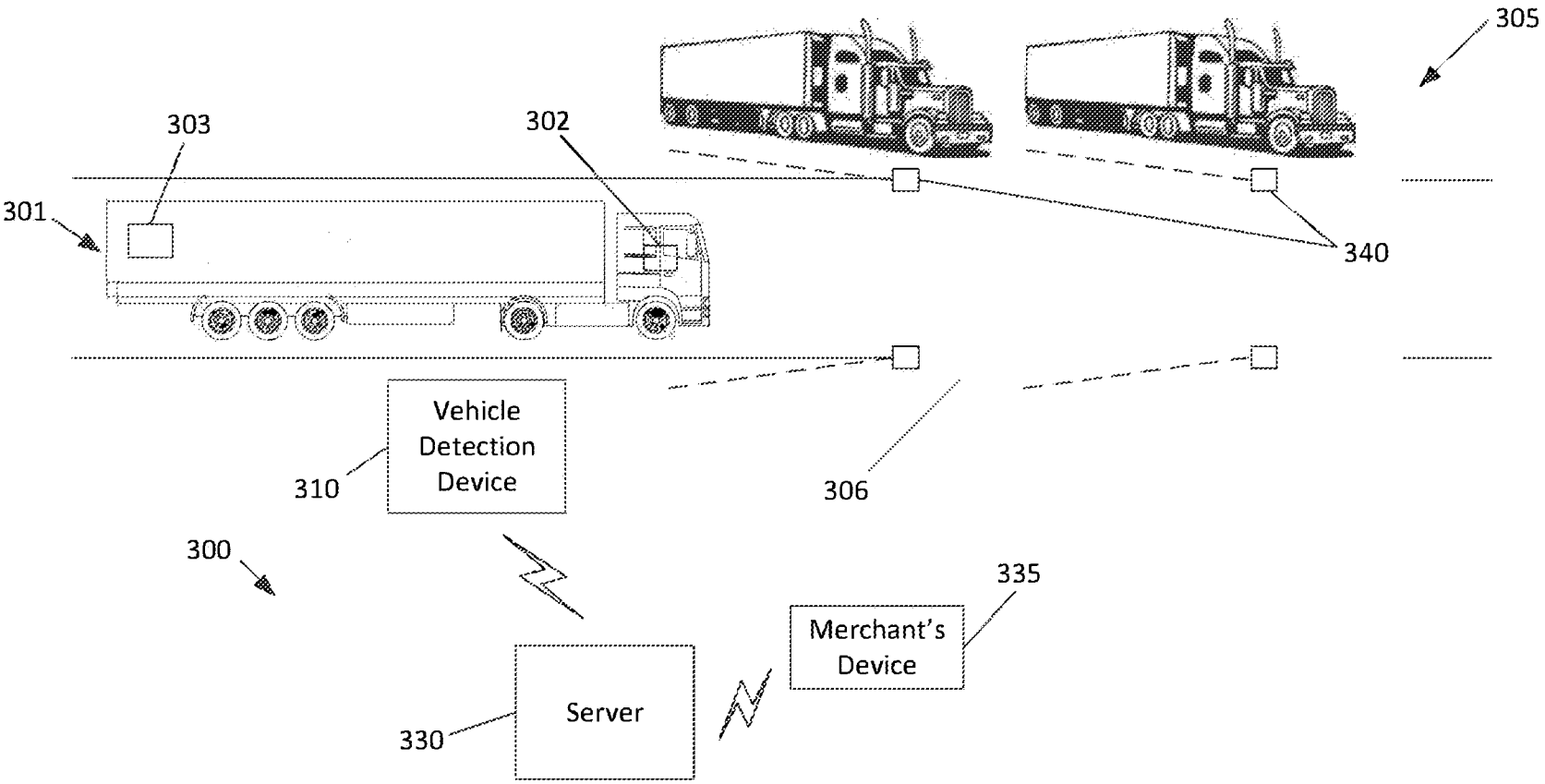
FIG. 3 is a block diagram of a system for monitoring arrival of vehicles, as installed at a shipping log, in accordance with the present disclosure.

Yet another application for the system 300 in which the system 300 is employed at a shipping yard is now described with additional reference to FIG. 3. Here, the parking lot 305 is for trucks 301 at a shipping yard. The vehicle detection system 310 may retrieve a shipping manifest from the device 302, server 330, or shipping yard's device 335, and pass the shipping manifest along to any such device. The server 330 or shipping yard's device 335, knowing that the shipment having that shipping manifest has arrived, may notify the owner of the cargo. The server 330 may, either directly or via the vehicle detection system 310, notify the device 302 or the sensors 306 to direct the driver where to park the truck.

Additional sensors 303 may be placed in the cargo containers carried by the trucks 301, and these sensors may detect when the cargo container is being moved (for example, from a 301 to storage), and transmit that data to the server 330 via the vehicle detection device 310. The server 330 may then report that data to the shipping yard's device 335.

Figure 4B:
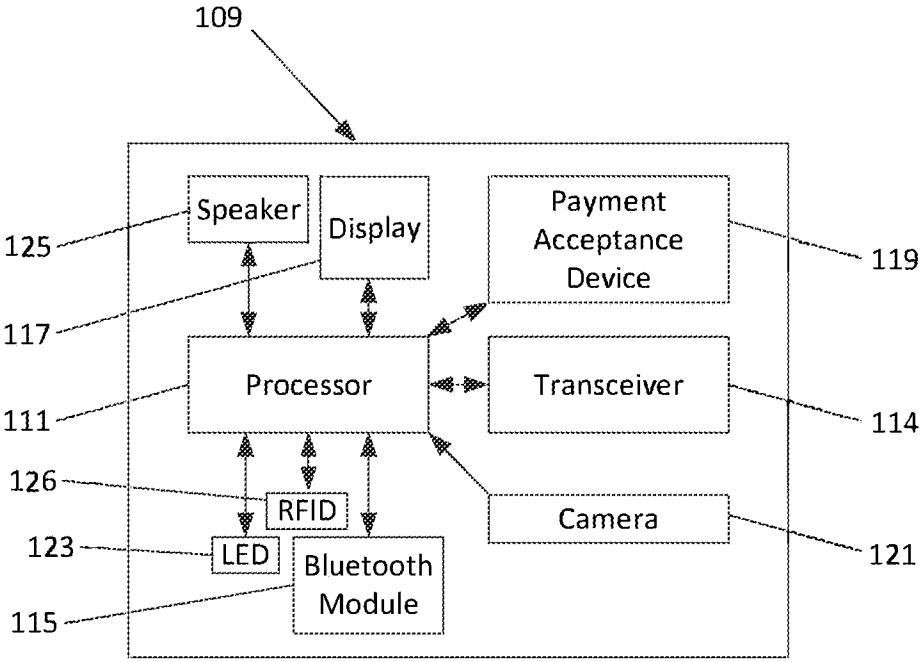
FIG. 4B is a block diagram of a hub device such as may be used with the systems shown in FIGS. 1-3.
Figure 6:
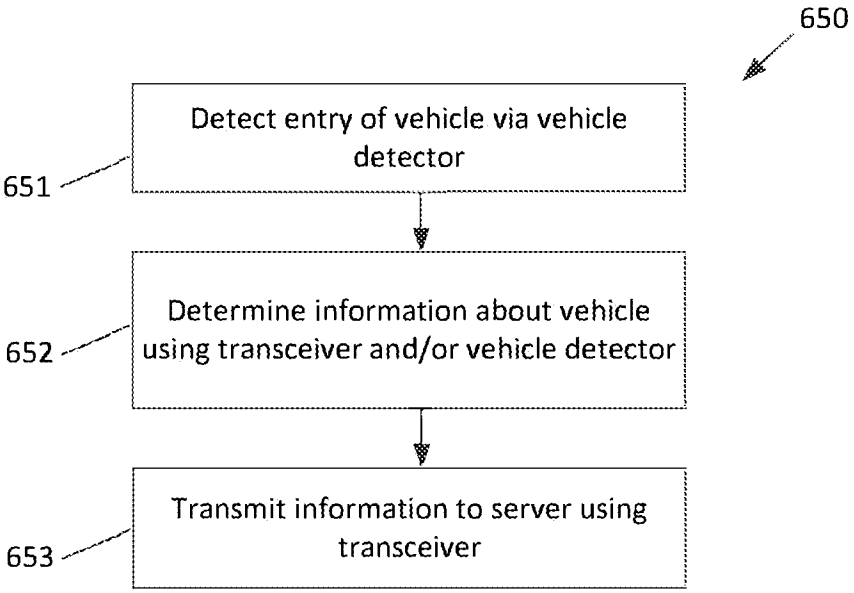
FIG. 6 is a flowchart of a method of operating the vehicle sensing device of FIG. 4A.

Further details of the vehicle sensing system 100 and vehicle sensing device 110 will now be given with reference to FIGS. 4 and 6. A method of operating the vehicle sensing device 110, described with reference to flowchart 650, includes detecting entry of the vehicle to the given area via the vehicle detector (e.g. magnetometer 112, accelerometer 113, etc) at Block 651. Thereafter, the method includes determining information about the vehicle, in response to sensing arrival of the vehicle to the given location, using the wireless transceiver 114 and/or the vehicle detector (e.g. magnetometer 112, accelerometer 113, etc) at Block 652. Then, the method continued with transmitting information to the server using the transceiver 114 at Block 653.

In some instances, the processor 111 may transmit an application trigger to cause the device within the vehicle (e.g. smartphone, infotainment system, etc) to launch an application. This application may prompt the user for payment, provide the user with notice that they are authorized or not authorized, provide the user with information about where to park, where to pick up cargo, or where to drop off cargo, provide the user with information about valet parking (such as price), or provide the user with information about an order from a merchant.

In some applications, for example such as the one shown in FIG. 1C, rather than a vehicle sensing device performing the above steps, a hub 109 works in accordance with a counting device 141 to perform the above functions. The hub 109 contains similar components to the vehicle sensing device described above, as is apparent from FIG. 4B, and has similar functionality to the vehicle sensing device as well, with the exception being that it lacks a magnetometer and accelerometer, and instead determines arrival and departure of vehicles via triggering of the counting device 141 by the weight of the vehicles driving over the counting device 141. It should be appreciated that the hub 109 may actually be a portable wireless electronic device, such as a smartphone or tablet.

Figure 7A:
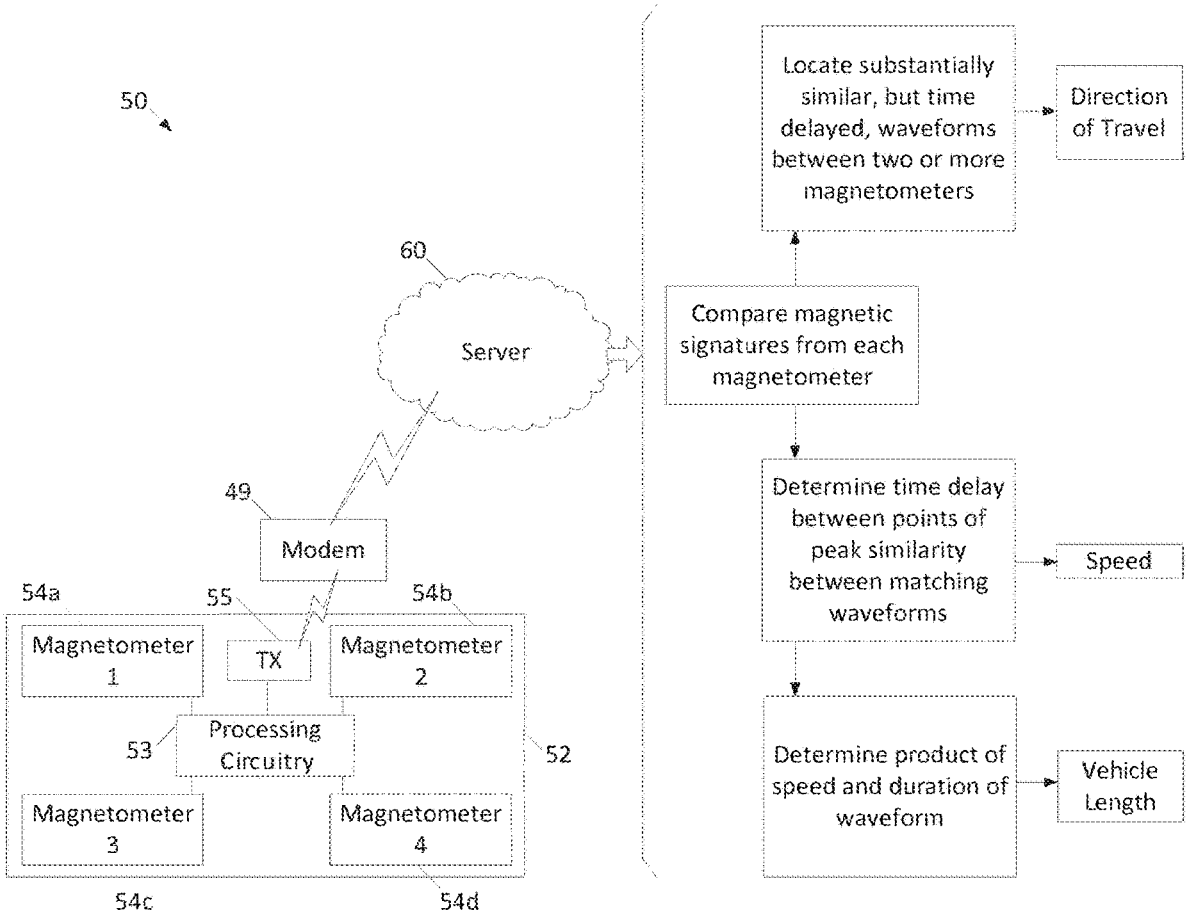
FIG. 7A is a block diagram of a parking system including vehicle sensors, the parking system being capable of determining the direction and speed of vehicles entering or exiting the parking lot. In the parking system shown in FIG. 1A, a cloud server performs the determination of direction and speed of vehicles.
Figure 7B:
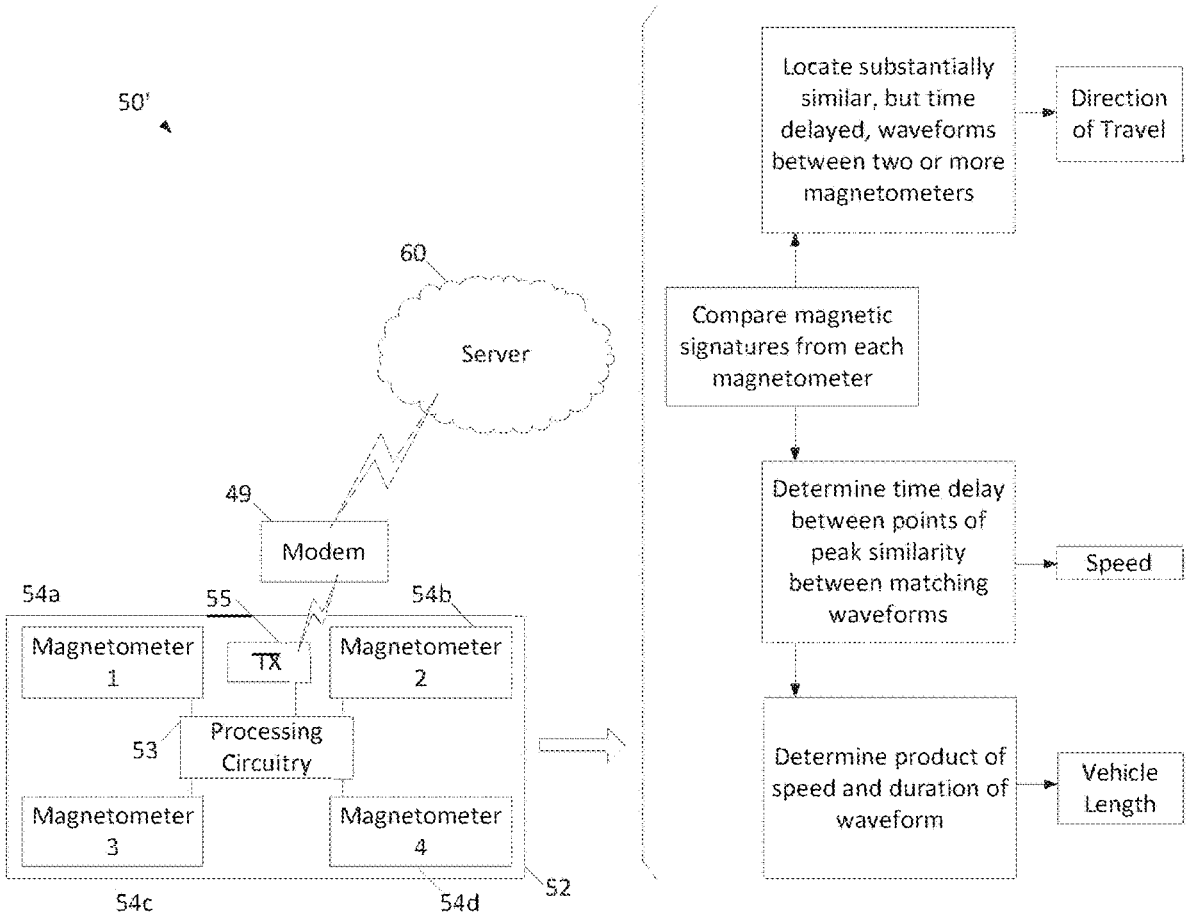
FIG. 7B is a block diagram of a parking system including vehicle sensors, the parking system being capable of determining the direction and speed of vehicles entering or exiting the parking lot. In the parking system shown in FIG. 1B, processing circuitry local to a sensor apparatus performs the determination of the direction and speed of vehicles.

With initial reference to FIGS. 7A-7B, a parking system 50 is now described. The parking system 50 includes one or more parking sensor apparatuses 52 situated at the entrance or exit lanes to a parking lot. Each parking sensor apparatus 52 includes, for example, four three-axis magnetometers 54*a*-54*d* positioned in a rectangular shape. The magnetometers 54*a*-54*d* are coupled to processing circuitry 53, such as an application specific integrated circuit. The processing circuitry 53 is coupled to a transmitter 55, which wirelessly communicates with modem 49. In some applications, such as that shown in FIG. 7A, the processing circuitry 53 converts signals received from the magnetometers 54*a*-54*d* into a format usable by cellular modem 49 for transmission to a cloud based server 60. In other applications, such as that shown in FIG. 7B, the processing circuitry 53 processes the signals received from the magnetometers 54*a*-54*d* to determine the properties of vehicles driving over the parking sensor apparatus 52 (such as speed, direction, length, etc) and sends those determined values to the cloud based server 60.

Which configuration is used for a given installation may depend on the particular details of that installation. For example, if the parking sensor apparatus 52 and cellular modem 49 is to be powered by a battery, using the processing circuitry 53 to determine the properties of the vehicles so as to reduce the amount of data sent by the cellular modem 49 may help provide for greater battery life over sending the signals from the magnetometers 54*a*-54*d* to the cloud based server 60. On the other hand, where battery life is not a concern, it may be desirable for the cloud based server 60 to determine the properties of the vehicles so as to allow for easy updating of the analysis techniques used, as well as for additional data processing power.

The magnetometers 54*a*-54*d* may each have analog to digital conversion circuitry associated therewith (not shown), or packaged therewith (not shown), that sends data to the processing circuitry 53 directly or over a bus connection.

It should be understood that although the modem 49 has been described as a cellular modem, it may in some cases instead be a wireless network transceiver (e.g. WiFi), or may be a wired network interface (e.g. Ethernet).

In operation, a vehicle drives over the parking apparatus 52, and each magnetometer 54*a*-54*d* of the parking apparatus 52 repeatedly produces a waveform corresponding to magnetic features, or a magnetic signature, of the vehicle, at a rate of, for example, 50 times per second to 800 times per second. The Inventor has found that the specific waveforms produced for different vehicles are influenced by unpredictable factors, making extraction of information directly from the waveforms to be difficult. However, the Inventor has also found that the specific waveforms produced by a given vehicle are consistent across the magnetometers 54*a*-54*d*. Therefore, by comparing the waveforms produced by the magnetometers 54*a*-54*d* to one another while varying an applied time offset, in response to a car driving over the parking apparatus 52, the direction and speed of the vehicle may be determined.

Figure 10:
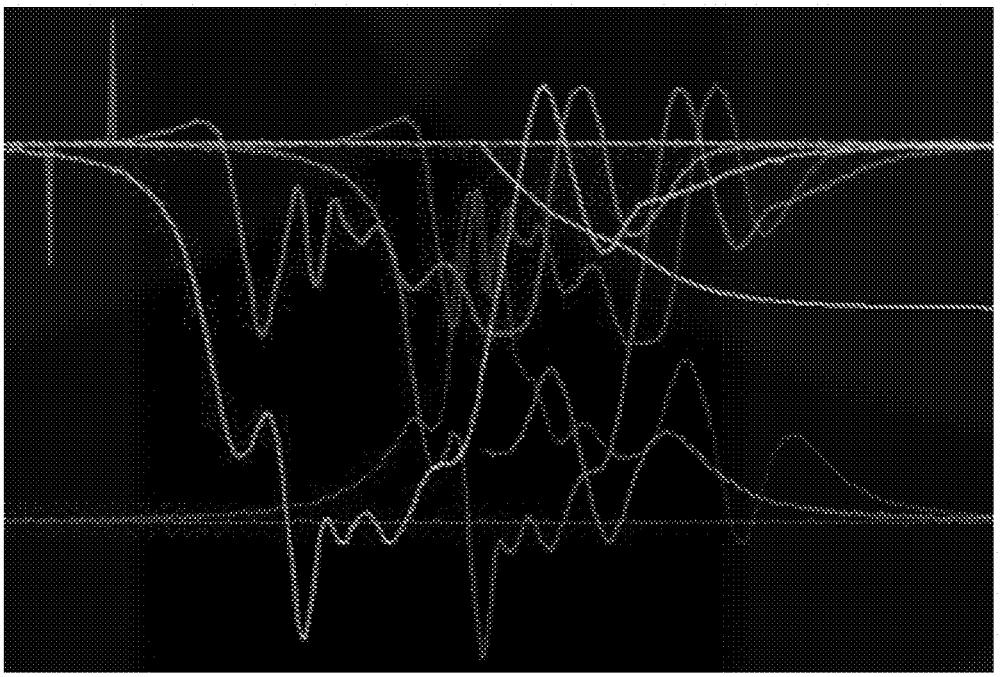
FIG. 10 is a graph showing magnetic signatures of a Toyota 4Runner that are delayed with respect to one another.
Figure 11:
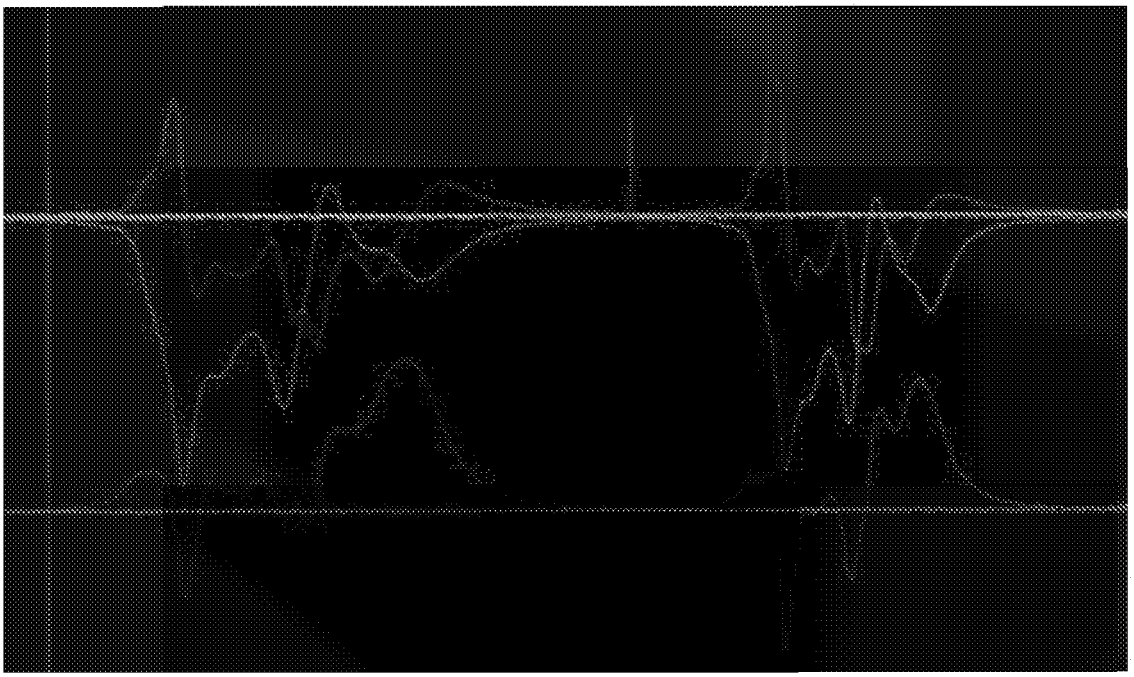
FIG. 11 is a graph showing magnetic signatures of a Ford F-150 that are delayed with respect to one another.

The server 60 may perform the above mentioned comparisons (FIG. 7A), or the processing circuitry 53 may perform the above mentioned comparisons (FIG. 7B). Since each magnetometer 54*a*-54*d* produces numerous magnetic signatures of the vehicle as it drives over, each waveform from each magnetometer 54*a*-54*d* is compared to each waveform from each other magnetometer 54*a*-54*d* while a variable time offset therebetween is adjusted so as to locate a match. Examples of such comparisons are shown in FIGS. 10-11, with FIG. 10 showing magnetic signatures for a Toyota 4Runner SUV, and FIG. 11 showing magnetic signatures for a Ford F-150.

When two waveforms from adjacent magnetometers (from among 54*a*-54*d*) are substantially similar or identical, and not time shifted with respect to one another (and thus, little to no offset is needed), this indicates that the vehicle has driven across those magnetometers in a same direction. However, when two waveforms from adjacent magnetometers (from among 54*a*-54*d*) are substantially similar or identical, as well as being time shifted with respect to one another (thus, offset is needed to produce the match), this indicates that the vehicle has driven in a direction from the magnetometer producing the earlier in time version of the waveform to the magnetometer producing the later in time version of the waveform. For example, if the waveforms produced by magnetometers 54*a* and 54*b* are substantially similar or identical, with the waveform produced by magnetometer 54*b* being delayed with respect to the waveform produced by magnetometer 54*a*, then the direction of the vehicle is in a direction from magnetometer 54*a* to magnetometer 54*b*.

Using this information, the server 60 can accurately maintain a count of the number of vehicles in the parking lot, even when a vehicle enters through a designated exit, exits through a designated entrance, or enters or exits through an undefined area serving as both entry and exit. Where the direction of the vehicle indicates that the vehicle is leaving the parking lot, the count of the number of vehicles in the parking lot is decremented by the server 60; likewise, where the direction of the vehicle indicates that the vehicle is entering the parking lot, the count of the number of the vehicles in the parking lot is incremented by the server 60.

Figure 9:
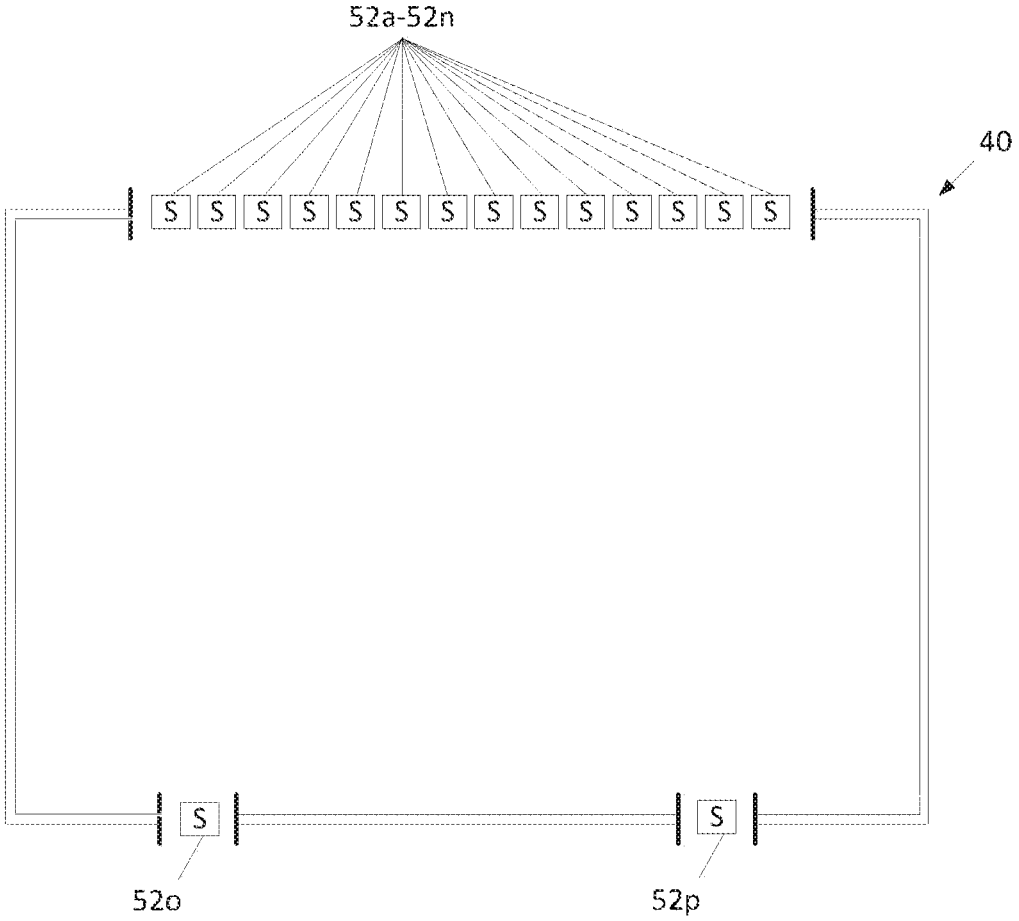
FIG. 9 is a top down view of a parking lot showing potential installation locations of the parking sensors and modems of FIGS. 7A-7B, and 8.

In addition, using such a system 50, a parking lot can utilize undesignated entrances and exits, permitting for quicker traffic flow in some scenarios (i.e. all act as entrances at a stadium prior to a sporting event, and all act as exits at the stadium after the sporting event) while still allowing for automated monitoring of parking inventors. Or, the parking lot may have a combination of defined and undefined entrances and exists. Such a configuration is shown in FIG. 9, where the parking lot 40 includes sensor apparatuses 52*o* and 52*p* located at defined single lane entrances or exits, and with sensor apparatuses 52*a*-52*n* located at a wide open undefined area through which vehicles may enter and exit.

Figure 12:
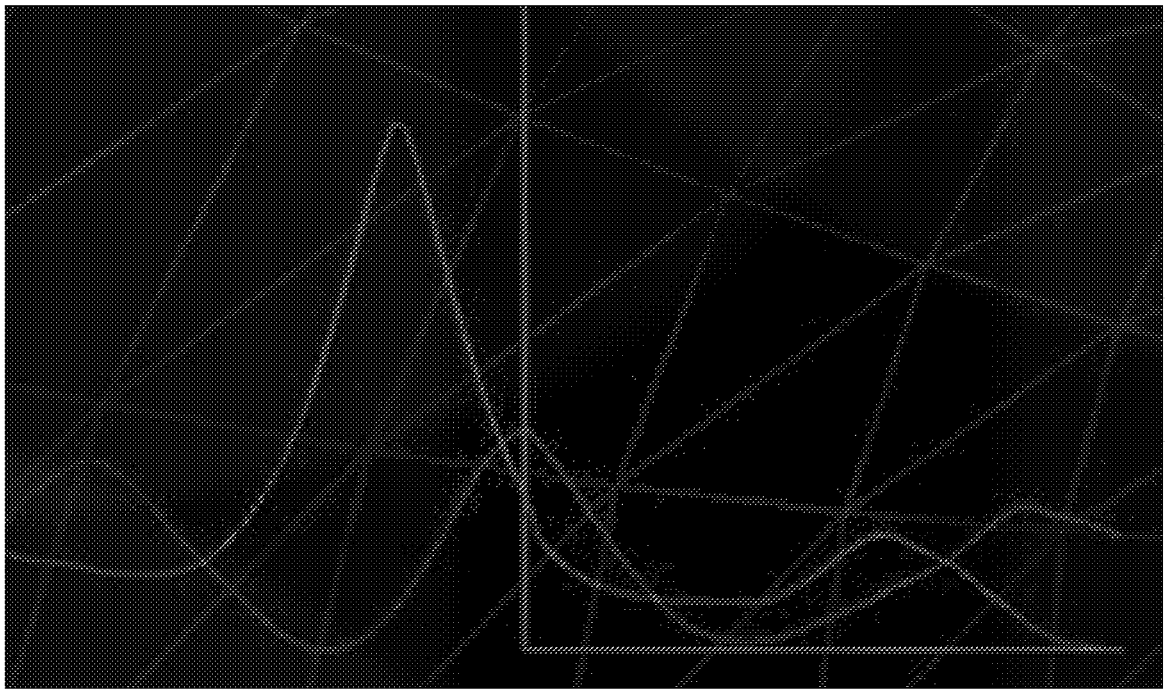
FIG. 12 is a graph showing points of peak similarity between magnetic signatures and the delay between those points of peak similarity.

It should be understood that by identifying and analyzing points of peak similarity between similar but time delayed waveforms and determining the time delay, the server 60 or processing circuitry 53 may determine the speed of the vehicle. For example, speed can be calculated as distance/time, the distance between the various magnetometers 54*a*-54*d* is known. Therefore, as an example, the speed may be calculated as the distance between the magnetometers (from among 54*a*-54*d*) that generated a pair of similar yet time delayed with respect to one another waveforms, divided by the time delay between peak values of those waveforms. Using points of peak similarity, such as peak values, zero crossings, or other readily identifiable features for delay comparisons allows for a more precise match between the waveforms than simply using a beginning or end of the waveform for the delay comparisons. A graph showing points of peak similarity between magnetic signatures and the delay between those points of peak similarity is shown in FIG. 12, where the X axis corresponds to time-delays where peak similarities have occurred between compared magnetic signatures, and where the Y axis corresponds to the degree of that similarity.

Additionally, the determined speed of the vehicle may be used in further calculations. For example, the server 60 or processing circuitry 53 may estimate a length of the vehicle as a product of the determined speed and a duration of the waveform. From the estimated length, the server 60 may then estimate whether the vehicle is a car, truck, SUV, or commercial vehicle by comparing the length to a series of threshold sizes. The server 60 may determine the vehicle to be a commercial vehicle if the length is greater than an upper threshold, may determine the vehicle to be a truck or SUV if the vehicle's length is greater than or equal to a middle threshold and less than the upper threshold, and may determine the vehicle to be a car if the vehicle's length is greater than or equal to a lower threshold and less than the middle threshold length. In some cases, the server 60 may use upper and lower threshold lengths, with the vehicle length being greater than the upper threshold meaning that the vehicle is a commercial vehicle, and the vehicle length being greater than or equal to a lower threshold and less than the upper threshold meaning that the vehicle is a private vehicle. Indeed, it should be appreciated that any suitable thresholds, number of thresholds, and comparison operators may be used.

It should also be appreciated that this functionality can be used to reject a waveform as representing a false positive, such as where the vehicle length is less than the lower threshold. This may mean that a pedestrian carrying a metallic object, or riding a metallic object such as a wheelchair, mobility cart, or bicycle has passed over the sensor apparatus 52, and thus should not be counted in the determination of parking lot space inventory.

It should be understood that although the parking apparatus 52 as shown includes four magnetometers 54*a*-54*d* arranged into a rectangular shape, other numbers of magnetometers and other shapes may be used. Indeed, there may be two, three, five, six, or any suitable number of magnetometers arranged into any usable shape.

As an example, there may be two magnetometers spaced apart from one another. This design may be suitable for entrances and exits to parking lots where physical barriers ensure that vehicles will drive over the magnetometers in either a forward or a reverse direction, and not at other angles. As another example, three magnetometers may be arranged into a triangular shape. This arrangement may be suitable for entrances and exits to parking lots without physical barriers restricting the movement of vehicles, such that vehicles may drive over the magnetometers from multiple different directions. However, depending on the specific triangular arrangement and the placement of the parking apparatus at the parking lot, the same part of vehicles entering or exiting the parking lot may not drive over two of the magnetometers, which can lead to a greater amount of inaccuracy in the determination of speed and direction of the vehicle. By arranging four magnetometers into a rectangular shape, the likelihood of the same part of vehicles entering or exiting the parking lot not driving over two of the magnetometers is reduced, with the tradeoff being the use of an additional magnetometer together with the spending of processing power to analyze the data from that additional magnetometer.

Figure 8:
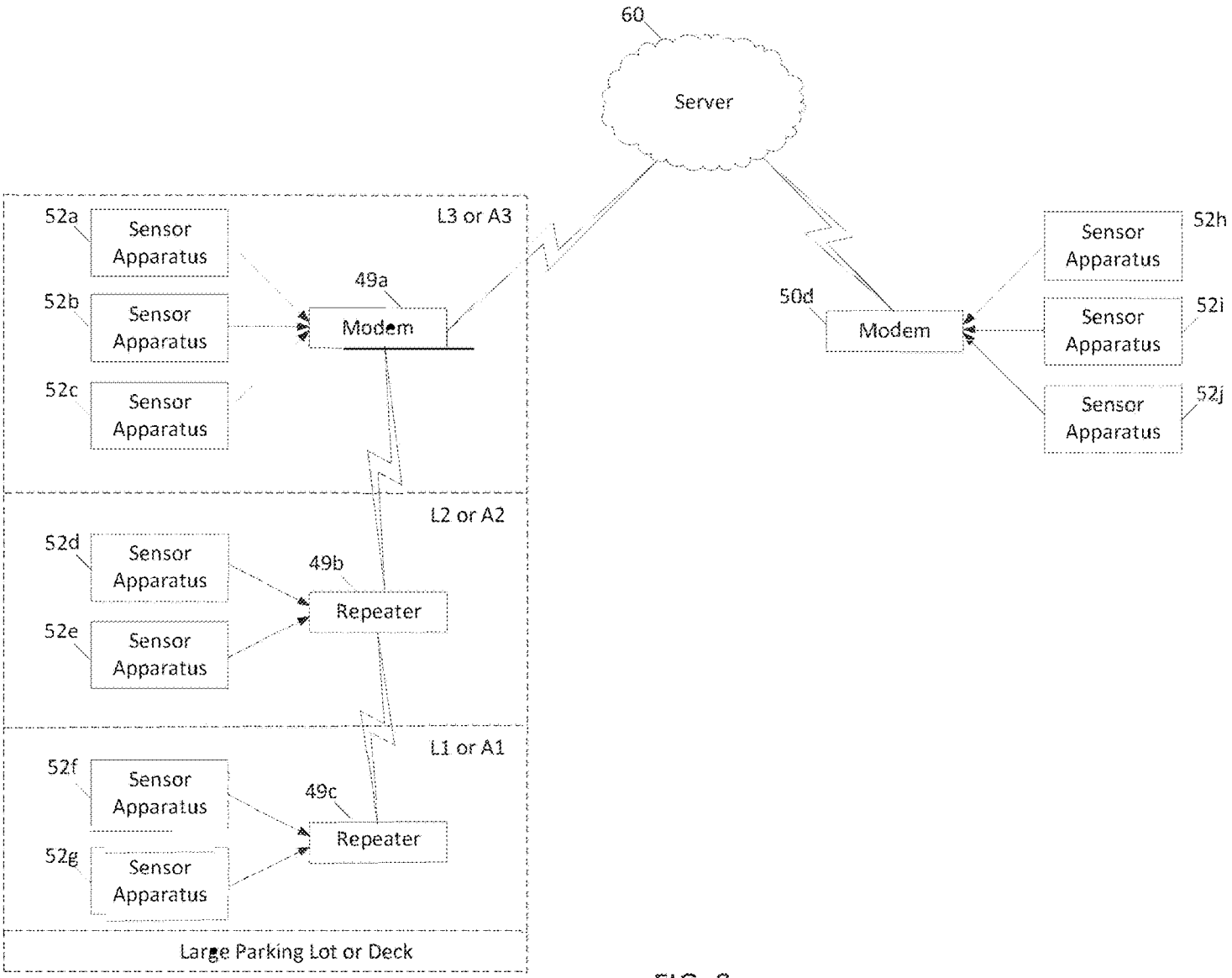
FIG. 8 is a block diagram showing possible network topologies for the parking system of FIGS. 7A-7B as installed in different kinds of parking lots.

Potential network topologies for the parking system 50 are now described with reference to FIG. 8. In some cases, the parking lot in which the system 50 is located may be small enough such that a single modem is in communication distance with each sensor apparatus, such as that shown in FIG. 8 where modem 49*d* is in communication with sensor apparatuses 52*h*-52*j*. However, in some cases, the parking lot in which the system 50 is located may be too large, or may be multi-level, for direct communication between each sensor apparatus and the modem to be feasable. Thus, in these cases, repeaters may be used. For example, as shown in FIG. 8, sensor apparatuses 52*f*-52*g* on a first floor or in a first area may communicate with repeater 49*c*, which in turn communicates with repeater 49*b* on a second floor or in a second area, which in turn communicates with modem 49*a* on a third floor or in a third area. Here, repeater 49*b* communicates with sensor apparatuses 52*d*-52*e*, and modem 49*a* communicates with sensor apparatuses 52*a*-52*c*.

Figure 13:
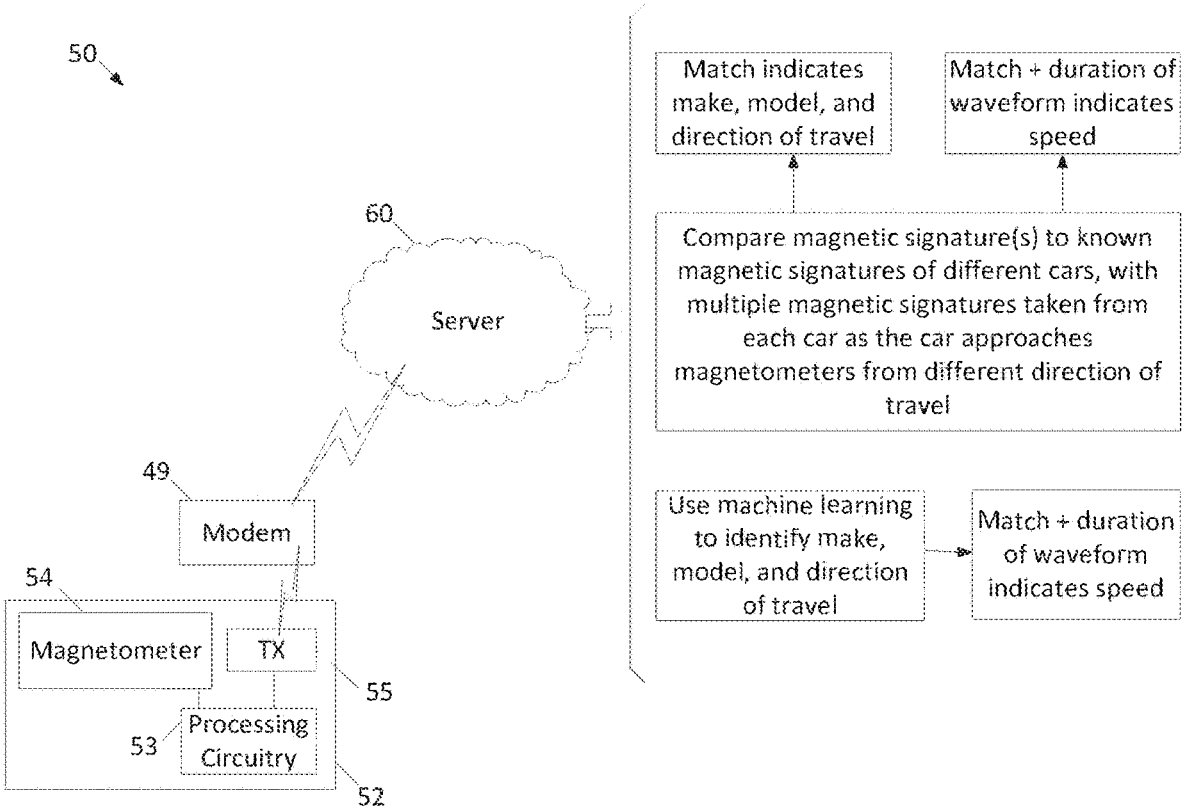
FIG. 13 is a block diagram of a parking system including a vehicle sensor, the parking system being capable of determining the make and model of vehicles entering or exiting the parking lot. In the parking system shown in FIG. 1A, a cloud server performs the determination of the make and model of the vehicles.

With additional reference to FIG. 13, an alternative embodiment of the parking system 50' is now described. Here, instead of or in addition to the comparison of the waveforms from the magnetometer 54 to waveforms from other magnetometers, the server 60 or processing circuitry 53 may instead compare the waveforms from the magnetometer 54 to a knowledge base of known waveforms for known vehicles. Each known vehicle may have multiple known waveforms associated with it and stored in the knowledge base. These multiple known waveforms for each known vehicle may each be a waveform of the vehicle driving over the sensor apparatus 52 from a different direction or angle. These known waveforms may each be directly measured using a sensor apparatus identical to, or similar to, that of the sensor apparatus 52; alternatively, some known waveforms may be directly measured, while others may be extrapolated from those that were directly measured.

When the server 60 or processing circuitry 53 locates a match between a waveform from the magnetometer 54 and a known waveform, the server 60 or processing circuitry 53 can then retrieve information about the known vehicle associated with that waveform, such as the make and model, vehicle orientation, direction of travel, and position of vehicle relative to the sensor apparatus 52. This is possible because a vehicle of a given make and model will produce a different waveform depending on the direction or orientation in which it is facing and traveling as it drives over the sensor apparatus 52. Thus, for example, waveforms from magnetometer 54 may match those of a Ford F-150 driving across the sensor apparatus 52 at a 45 degree angle from the lower left corner of the sensor apparatus 52 to the upper right corner of the sensor apparatus 52. As another example, waveforms from magnetometer 54 may match those of a Toyota 4Runner driving across the sensor apparatus 52 from the right to the left, with the sensor apparatus substantially centered along a longitudinal axis of the vehicle, in a reverse direction. Thus, it can be seen that through match measured waveforms to known waveforms for known vehicles, a varieties of pieces of information about the vehicle may be deduced.

Instead of comparing each measured waveform from the magnetometer 54 to a knowledge base, in some cases, the server 60 or processing circuitry 53 may use a learned machine technique to identify the make, model, vehicle orientation, direction of travel, and position of the vehicle relative to the sensor apparatus 52. This learned machine technique, utilized by the server 60 or magnetometer, may be produced using a machine learning technique (such as using an artificial neural network) performed on the aforementioned knowledgebase or similar, and may be continually updated.

Regardless of the technique employed (either matching or machine learning) to determine the make, model, vehicle orientation, direction of travel, and position of the vehicle relative to the sensor apparatus 52, the speed of the vehicle may be estimated from the length of the known identified vehicle multiplied by the duration of the measured waveforms from the magnetometer 54.

It should also be understood that in some instances, accelerometers may be used in conjunction with magnetometers. For example, the accelerometers may be positioned adjacent to the magnetometers, and vibration signatures may be collected together with the magnetic signatures. In addition, the vibration signatures may be compared and analyzed like the magnetometers as described above, and the results thereof may be fused or combined with the results of comparing and analyzing the magnetic signatures to produce more accurate results. Furthermore, in some instances, accelerometers may be used instead of magnetometers, and vibration signatures may be collected, compared, and analyzed like the magnetometers as described above.

Although the preceding description has been described herein with reference to particular means, materials and embodiments, it is not intended to be limited to the particulars disclosed herein; rather, it extends to all functionally equivalent structures, methods, and uses, such as are within the scope of the appended claims.

The invention claimed is:

1. A system comprising:

a sensor apparatus comprising an array of magnetometers each configured to respectively generate magnetic signatures of a vehicle;

a computing device associated with the sensor apparatus and configured to:

compare the magnetic signatures of the vehicle generated by at least a first portion of the array of magnetometers comprising a first and a second magnetometer to the magnetic signatures of the vehicle generated by at least a second portion of the array of magnetometers comprising a third magnetometer so as to determine a direction of travel of the vehicle, wherein the first and the second magnetometer of the first portion of the array of magnetometers are emplaced spaced apart along a line that is substantially in a direction of vehicle travel and wherein (i) the first magnetometer and (ii) the second magnetometer both generate substantially similar magnetic signatures of the vehicle being time shifted relative to each other, and wherein at least a portion of the first portion of the array of magnetometers and at least a portion of the second portion of the array of magnetometers are emplaced on different sides of the line that is substantially in the direction of vehicle travel, wherein (i) the at least the portion of the first portion of the array of magnetometers and (ii) the at least the portion of the second portion of the array of magnetometers generate substantially similar magnetic signatures substantially not time shifted relative to each other, and whereby the comparing determines the direction of vehicle travel of the vehicle relative to the emplaced magnetometers.

2. The system of claim 1, further comprising a network transceiver associated with the computing device and configured to send the direction of the vehicle to a cloud server.

3. The system of claim 2, wherein the sensor apparatus is disposed at an entrance or exit to a parking lot, wherein the cloud server is further configured to increment a counter representing a number of cars in the parking lot as a function of the direction of travel of the vehicle being into the parking lot, and wherein the cloud server is further configured to decrement the counter as a function of the direction of travel of the vehicle being out of the parking lot.

4. The system of claim 1, further comprising a network transceiver associated with the computing device and configured to send the magnetic signatures of the vehicle to the computing device, and wherein the computing device is a cloud server.

5. The system of claim 1, wherein the computing device is further configured to determine a time delay between magnetic signatures of the vehicle, with the direction of travel of the vehicle being in a direction from the first magnetometer that produced the magnetic signature first in time to the second magnetometer that produced the magnetic signature of the vehicle second in time.

6. The system of claim 5, wherein the computing device is further configured to derive a speed of the vehicle as a function of a time difference between points of peak similarity between magnetic signatures of the vehicle.

7. The system of claim 6, wherein the computing device is further configured to estimate a length of the vehicle as a product of the speed of the vehicle and a duration of the magnetic signatures of the vehicle.

8. The system of claim 7, wherein the computing device is further configured to determine the magnetic signature to represent a false positive as a function of the estimated length of the vehicle being less than a threshold length.

9. The system of claim 7, wherein the computing device is further configured to determine the vehicle to be a commercial vehicle as a function of the length of the vehicle being greater than an upper vehicle threshold length.

10. The system of claim 7, wherein the computing device is further configured to determine the vehicle to be a passenger vehicle as a function of the length of the vehicle being at least a lower vehicle threshold length and not more than an upper vehicle threshold length.

11. A method of parking lot inventory management, the method comprising:

disposing at least one sensor apparatus comprising a plurality of spaced apart magnetometers, at each entry or exit lane to the parking lot;

for each sensor apparatus, comparing one or more magnetic signature of a vehicle driving over that sensor apparatus generated by at least a first portion of the plurality of magnetometers of that sensor apparatus to one or more magnetic signature of the vehicle generated by at least a second portion of the plurality of magnetometers of that sensor apparatus so as to determine a direction of travel of the vehicle;

wherein the first portion and the second portion are spaced apart in a first direction, the first direction oriented such that a match between magnetic signatures of the vehicle as generated by the first portion and the second portion indicates that the direction of travel of the vehicle is along a second direction that is different than the first direction and that is a direction between the first and second portions that are spaced apart in the first direction;

incrementing a count of vehicles in the parking lot as a function of the direction of travel of the vehicle indicating that the vehicle is entering the parking lot; and decrementing a count of vehicles in the parking lot as a function of the direction of travel of the vehicle indicating that the vehicle is leaving the parking lot.

12. The method of claim 11, wherein an entry or exit lane of the parking lot is a defined entry or exit lane and a single sensor apparatus is disposed thereat.

13. The method of claim 11, further comprising determining a speed of the vehicle as a function of a time delay between points of peak similarity of the magnetic signatures of the vehicle.

14. The method of claim 13, further comprising estimating a length of the vehicle as a product of the speed of the vehicle and a duration of the magnetic signatures.

15. The method of claim 14, further comprising determining the magnetic signatures of the vehicle to represent a false positive as a function of the estimated length of the vehicle being less than a threshold length.

16. The method of claim 14, further comprising determining the vehicle to be a commercial vehicle as a function of the length of the vehicle being greater than an upper vehicle threshold length, and determining the vehicle to be a passenger vehicle as a function of the length of the vehicle being at least a lower vehicle threshold length and not more than the upper vehicle threshold length.

17. A system comprising:

a sensor apparatus comprising a plurality of sensors each configured to respectively generate signatures of a vehicle as the vehicle passes the sensor apparatus;

a computing device associated with the sensor apparatus and configured to:

compare the signatures of the vehicle generated by each of a first portion of the plurality of sensors to the signatures of the vehicle generated by each of a second portion of the plurality of sensors so as to determine a direction of travel of the vehicle, wherein the comparing comprises determining time delays between the signatures of the vehicle generated by each of the first portion and the second portion, wherein a null time delay between the signatures of the vehicle generated by each of the first portion and the second portion corresponds to the vehicle traveling substantially perpendicular to an axis connecting the first portion and the second portion.

* * * * *